US010856086B2

(12) United States Patent
Tamura et al.

(10) Patent No.: US 10,856,086 B2
(45) Date of Patent: Dec. 1, 2020

(54) PIEZOELECTRIC ACOUSTIC COMPONENT

(71) Applicants: HOKURIKU ELECTRIC INDUSTRY CO., LTD., Toyama (JP); ANDEN CO., LTD., Aichi (JP)

(72) Inventors: Masahide Tamura, Toyama (JP); Tadao Sunahara, Toyama (JP); Koji Hamada, Anjo (JP); Ryuta Suzuki, Anjo (JP)

(73) Assignees: HOKURIKU ELECTRIC INDUSTRY CO., LTD., Toyama (JP); DENSO ELECTRONICS CORPORATION, Aichi (JP)

( * ) Notice: Subject to any disclaimer, the term of this patent is extended or adjusted under 35 U.S.C. 154(b) by 0 days.

(21) Appl. No.: 16/499,553

(22) PCT Filed: Mar. 29, 2018

(86) PCT No.: PCT/JP2018/013264
§ 371 (c)(1),
(2) Date: Sep. 30, 2019

(87) PCT Pub. No.: WO2018/186280
PCT Pub. Date: Oct. 11, 2018

(65) Prior Publication Data

US 2020/0045475 A1 Feb. 6, 2020

(30) Foreign Application Priority Data

Apr. 3, 2017 (JP) ..... 2017-073858

(51) Int. Cl.
*H04R 17/10* (2006.01)
*G10K 11/02* (2006.01)
*H04R 7/18* (2006.01)

(52) U.S. Cl.
CPC ..... *H04R 17/10* (2013.01); *G10K 11/02* (2013.01); *H04R 7/18* (2013.01)

(58) Field of Classification Search
CPC ..... H04R 17/10; H04R 7/18; G10K 11/02
(Continued)

(56) References Cited

U.S. PATENT DOCUMENTS

2003/0099371 A1* 5/2003 Ogura ..... H04R 17/00 381/426
2004/0205949 A1* 10/2004 Takeshima ..... H04R 31/003 29/25.35

(Continued)

FOREIGN PATENT DOCUMENTS

JP 3436205 6/2003
JP 2006-303770 11/2006

(Continued)

OTHER PUBLICATIONS

International Search Report dated Jun. 19, 2018, 2 pages.

*Primary Examiner* — Fan S Tsang
*Assistant Examiner* — Julie X Dang
(74) *Attorney, Agent, or Firm* — Rankin, Hill & Clark LLP

(57) ABSTRACT

A piezoelectric sounding element includes a diaphragm made of metal and a piezoelectric element provided on at least one surface of the diaphragm. A non-fixed portion of the diaphragm includes the pair of long sides facing each other, a pair of short sides, shorter than the long sides, that face each other, and a pair of recesses, provided in the pair of long sides, that protrude so as to approach each other. The piezoelectric element is provided in a region between the pair of recesses of the diaphragm and the contour shapes of the non-fixed portion of the diaphragm and the piezoelectric element are defined so as to be symmetric with respect to a first imaginary line that bisects the pair of short sides and (Continued)

symmetric with respect to a second imaginary line that bisects the pair of long sides.

20 Claims, 24 Drawing Sheets

(58) Field of Classification Search
USPC ..... 381/190, 191, 173, 151, 175
See application file for complete search history.

(56) References Cited

U.S. PATENT DOCUMENTS

| | | | | |
|---|---|---|---|---|
| 2006/0126869 | A1 | 6/2006 | Chiang | |
| 2010/0239109 | A1* | 9/2010 | Lutz | H04R 31/006 381/190 |
| 2012/0057728 | A1* | 3/2012 | Fujise | H04R 17/00 381/162 |
| 2014/0241550 | A1* | 8/2014 | Sunahara | G10K 9/122 381/190 |

FOREIGN PATENT DOCUMENTS

| | | |
|---|---|---|
| JP | 2012-029087 | 2/2012 |
| JP | 2012-217013 | 11/2012 |

* cited by examiner

[PZT CERAMIC HAVING A LENGTH OF 9 mm (1/3 OF ENTIRE LENGTH)]
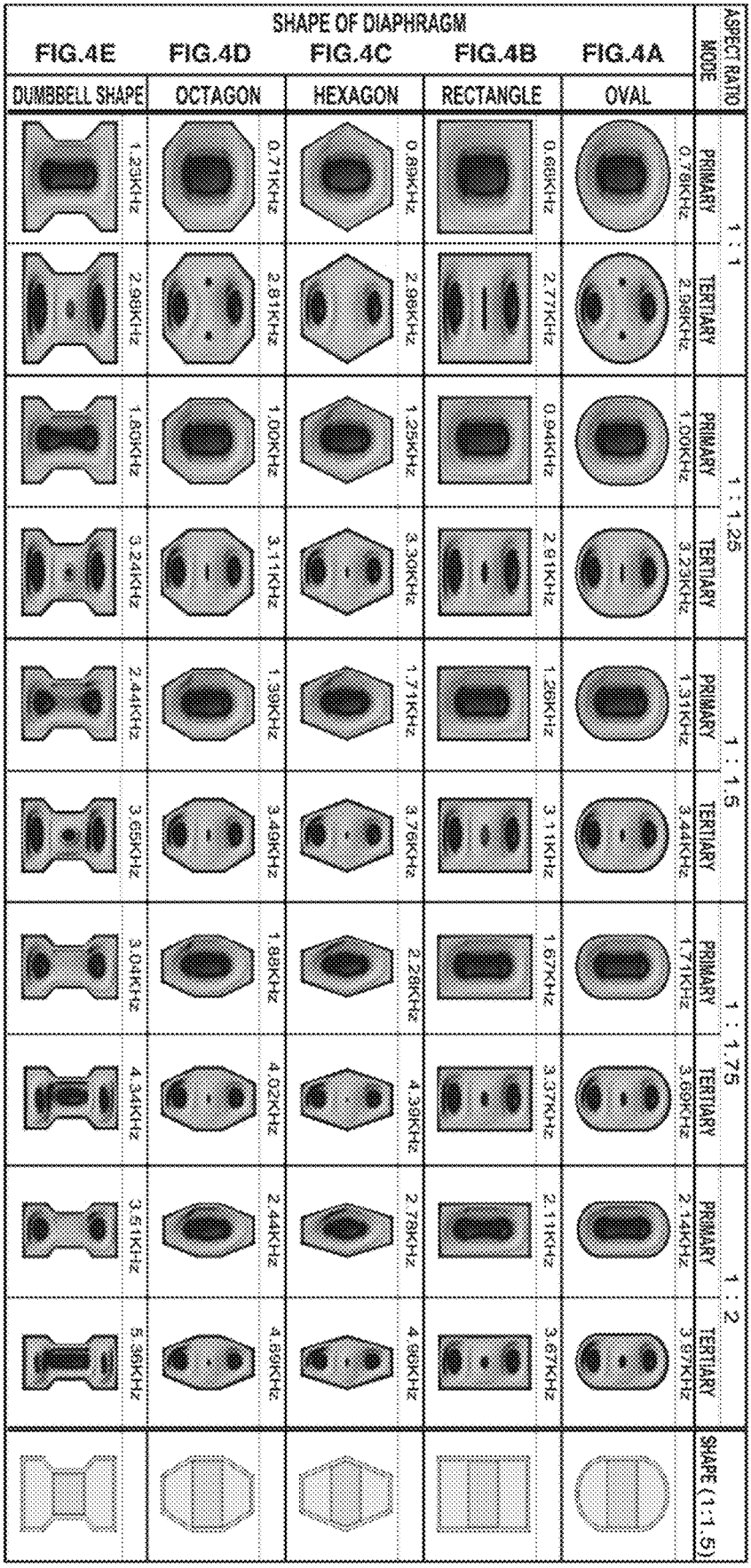

OVAL 1.6

RECTANGLE 1.75

HEXAGON 1.55

OCTAGON 1.35

DUMBBELL SHAPE 1.25

FIG.8A
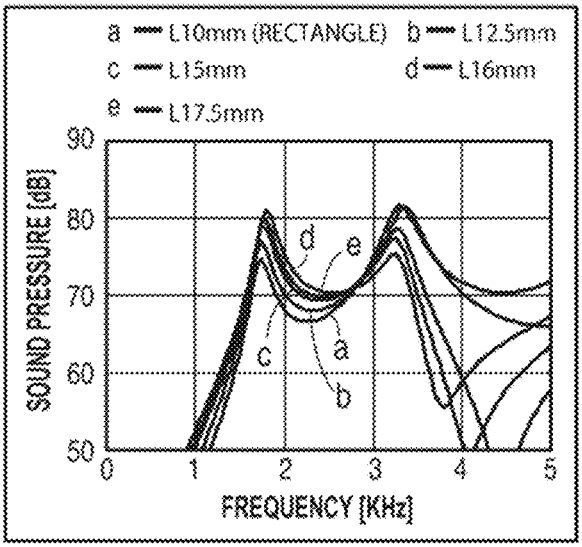
FIG.8B
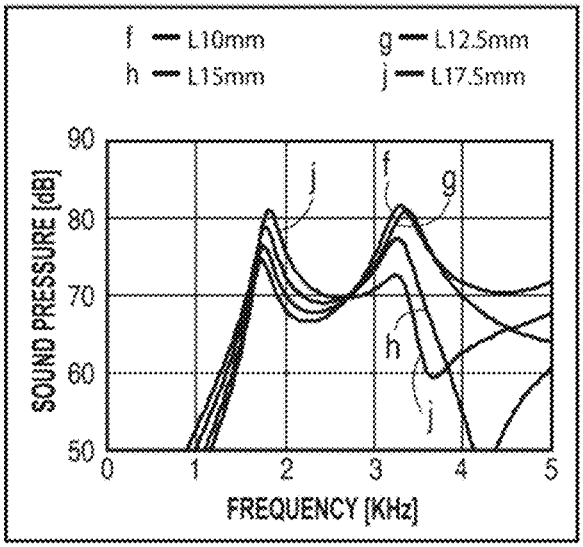
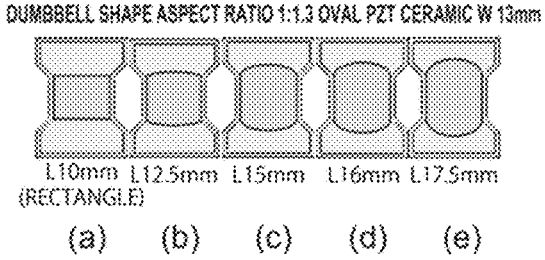
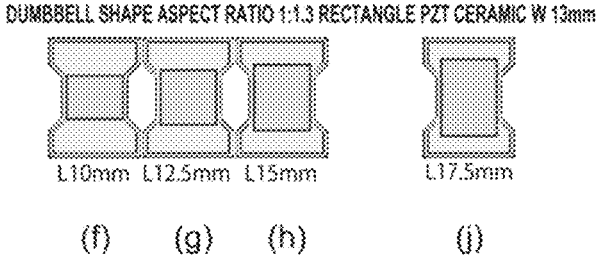

ASPECT RATIO 1:1.4

PRIMARY VIBRATION MODE

TERTIARY VIBRATION MODE

QUATERNARY VIBRATION MODE

QUINARY VIBRATION MODE

PIEZOELECTRIC ACOUSTIC COMPONENT

TECHNICAL FIELD

The present invention relates to a piezoelectric acoustic component that has a piezoelectric sounding element housed in a case with sound emission holes and is capable of obtaining a sound pressure more than a predetermined value in a frequency range of multiple musical scales.

BACKGROUND ART

Japanese Patent No. 3436205 (Patent Literature 1) discloses, in FIG. 7, a piezoelectric acoustic component having, in a case provided with sound emission holes, a piezoelectric vibrator obtained by pasting a piezoelectric element with a rectangular contour to a metal diaphragm with a rectangular contour. This piezoelectric acoustic component is a so-called piezoelectric speaker capable of emitting sound in a wide frequency range.

PRIOR ART DOCUMENTS

Patent Literature

Patent Literature 1: Japanese Patent No. 3436205

SUMMARY OF INVENTION

Problems to be Solved by the Invention

Although the piezoelectric acoustic component disclosed in PTL 1 has a wide available frequency range, the sound pressure thereof is low. Accordingly, sound may not be audible in a noisy place such as, for example, the outdoors or vehicle interior. Therefore, a piezoelectric acoustic component capable of surely emitting audible sound of multiple musical scales is needed.

An object of the invention is to provide a piezoelectric acoustic component capable of emitting multiple musical scales even in a noisy place.

Means for Solving the Problem

The target to be improved by invention is a piezoelectric acoustic component including a piezoelectric sounding element including a diaphragm made of metal and a piezoelectric element provided on at least one surface of the diaphragm; and a case that fixes an outer peripheral portion of the diaphragm of the piezoelectric sounding element across an entire circumference, forms a first space and a second space on both sides of the piezoelectric sounding element, and configures a resonator by a volume of the first space and one or more sound emission holes formed in a wall portion facing the first space. In the piezoelectric acoustic component according to the invention, a non-fixed portion located inside the outer peripheral portion of the diaphragm includes a pair of long sides that face each other, a pair of short sides, shorter than the long sides, that face each other, and a pair of recesses, provided in the pair of long sides, that protrude in a direction approaching each other. The piezoelectric element is provided in a region between the pair of recesses of the non-fixed portion of the diaphragm and both a contour shape of the diaphragm and a contour shape of the piezoelectric element are defined so as to be symmetric with respect to a first imaginary line that bisects the pair of short sides and symmetric with respect to a second imaginary line that bisects the pair of long sides. In addition, ratio L1/W1 of length L1 of the long sides to length W1 of the short sides is defined so as to fall within a range from 1.25 to 1.75. In addition, the resonator is configured such that sound pressures at a primary resonance frequency, a tertiary resonance frequency, and an intermediate frequency between the primary resonance frequency and the tertiary resonance frequency when a sine wave signal is input as an input signal are 80 dB or more.

In particular, the resonator may be configured such that a minimum sound pressure between the primary resonance frequency and the intermediate frequency and a minimum sound pressure between the intermediate frequency and the tertiary resonance frequency are preferably 80 dB or more.

In addition, the resonator may be configured such that the sound pressure at the intermediate frequency between the primary resonance frequency and the tertiary resonance frequency is equal to or higher than the sound pressure at the primary resonance frequency and the sound pressure at the tertiary resonance frequency.

Since the piezoelectric acoustic component including a rectangular metal diaphragm provided with a so-called non-fixed portion has a smaller unavailable space (dead space) when mounting than a piezoelectric acoustic component including a circular or elliptic diaphragm, a certain demand is expected in products including a piezoelectric acoustic component. However, the piezoelectric acoustic component including the rectangular metal diaphragm cannot easily obtain a certain level of sound pressure in a predetermined frequency range. The inventors of the present invention has found that use of a diaphragm having recesses in a pair of long sides does not make the sound pressure at the primary resonance frequency and the frequency at the tertiary resonance frequency so high and achieves the frequency characteristics in which the difference between the sound pressures at these resonance frequencies is not large. In addition, the inventors have found that the resonator case having predetermined sound emission holes can increase the sound pressure in an intermediate frequency region between the primary resonance frequency and the tertiary resonance frequency. According to the invention developed based on such knowledge, it is possible to provide a piezoelectric acoustic component capable of obtaining a sound pressure of 80 dB or more across a frequency range of multiple musical scales. As a result, according to the invention, sound is audible even in a noisy place using a piezoelectric sounding element including a so-called rectangular metal diaphragm.

The case may include a sounding element holder having an opening with the same shape as the contour shape of the non-fixed portion of the diaphragm and fixes the outer peripheral portion of the diaphragm. When using such a sounding element holder, the contour shape of the non-fixed portion of the diaphragm is determined by the shape of the opening. As a result, a rectangular shape can be used as the shape of the diaphragm and this achieves cost reduction of machining cost of the diaphragm.

Each of the pair of short sides may have, in both end portions, a pair of inclined portions inclined in a direction approaching each other. When such a pair of inclined portions is provided, the sound pressure in frequency characteristics can be increased by changing the angle of the inclined portions.

Each of the recesses of the non-fixed portion of the diaphragm may have any shape. A typical shape of the recesses includes a parallel straight line portion extending in parallel with the first imaginary line and a pair of inclined straight line portions extending away from both end portions of the parallel straight line portion to corresponding remaining portions of the long side. In this case, an outline of the piezoelectric element preferably includes a pair of straight line portions along the parallel straight line portions of the pair of recesses and curved portions each of which is curved so as to protrude toward the pair of the short sides in a region sandwiched between the pair of inclined straight line portions of the pair of recesses facing each other in a direction in which the second imaginary line of the pair of recesses extends. The frequency difference between the primary resonance frequency and the tertiary resonance frequency can be adjusted by changing the curvature of the curved portion of the piezoelectric element as appropriate.

Each of the recesses of the non-fixed portion of the diaphragm may include a parallel straight line portion extending in parallel with the second imaginary line and a pair of protruding curved portions that extend away from both end portions of the parallel straight line portion and are curved so as to protrude toward the recesses. Also in this case, an outline of the piezoelectric element preferably includes a pair of straight line portions along the parallel straight line portions of the pair of recesses and a pair of curved portions each of which is curved so as to protrude toward the pair of the short sides in a region sandwiched between the pair of protruding curved portions of the recess. Also in this case, the frequency difference between the primary resonance frequency and the tertiary resonance frequency can be adjusted by changing the curvature of the curved portion of the piezoelectric element as appropriate.

In addition, each of the recesses of the non-fixed portion of the diaphragm may be a curved recess curved so as to protrude toward the second imaginary line and an outline of the piezoelectric element may have curved portions curved so as to protrude toward the pair of short sides in a region sandwiched between the pair of curved recesses along the pair of curved recesses.

It should be noted here that preferable practical conditions in use as a vehicle interior or exterior alarm for an automobile are described below. Preferably, the non-fixed portion of the diaphragm is formed by an alloy plate having a thickness of 10 m to 150 μm in which nickel is mixed with iron, the piezoelectric element has a structure in which a plurality of PZT ceramic layers each having a thickness of 10 μm to 35 μm is stacked with each other, and an acrylic adhesive for bonding the piezoelectric element to the diaphragm has a Shore D hardness of 75 to 85 and a thickness of 1 μm to 10 μm.

In addition, when a certain level of sound pressure is obtained at a frequency from approximately 2 kHz to approximately 3 kHz, the following structure is adopted in a piezoelectric acoustic component including a piezoelectric sounding element including a diaphragm made of metal and a piezoelectric element provided on at least one surface of the diaphragm and a case that fixes an outer peripheral portion of the diaphragm of the piezoelectric sounding element across an entire circumference, forms a first space and a second space on both sides of the piezoelectric sounding element, and has one or more sound emission holes in a wall portion facing the first space. That is, a non-fixed portion located inside the outer peripheral portion of the diaphragm includes a pair of long sides that face each other and a pair of short sides, shorter than the long sides, that face each other, and a pair of recesses, provided in the pair of long sides, that protrude in a direction approaching each other. The piezoelectric element is provided in a region between the pair of recesses of the non-fixed portion of the diaphragm. Both a contour shape of the diaphragm and a contour shape of the piezoelectric element are defined so as to be symmetric with respect to a first imaginary line that bisects the pair of short sides and symmetric with respect to a second imaginary line that bisects the pair of long sides. In addition, ratio L1/W1 of length L1 of the long sides to length W1 of the short sides is defined so as to fall within a range from 1.25 to 1.55, ratio L2/L1 of length L2 of an opening opened in the long sides of the recesses of the non-fixed portion of the diaphragm to length L1 of the long sides is 0.4 to 0.6, and ratio W2/W1 of dimension W2 between the pair of recesses in the direction toward the second imaginary line to length W1 of the short sides is 0.4 to 0.95. Also in this case, a total opening area of one or more sound emission holes and an air chamber capacity of the resonator having one or more sound emission holes are defined such that sound pressures at a primary resonance frequency, a tertiary resonance frequency, and an intermediate frequency between the primary resonance frequency and the tertiary resonance frequency when a sine wave signal is input as an input signal are 80 dB or more. In this case, the sound pressure at the intermediate frequency is preferably defined so as to be equal to or higher than the sound pressure at the primary resonance frequency and the sound pressure at the tertiary resonance frequency. In particular, the resonator is preferably configured such that a minimum sound pressure between the primary resonance frequency and the intermediate frequency and a minimum sound pressure between the intermediate frequency and the tertiary resonance frequency are 80 dB or more. In this case, preferably, ratio L1/W1 is 1.40 to 1.45, ratio L2/L1 is 0.45 to 0.55, and ratio W2/W1 is 0.55 to 0.59.

BRIEF DESCRIPTION OF DRAWINGS

FIG. 4 illustrates the shapes of the diaphragms, the regions of sections of vibrations, and the measurement results of the frequencies of the primary resonance frequency and the tertiary resonance frequency in the case where the aspect ratio is changed when oval (such as circular or elliptic) (A), rectangular (B), hexagonal (C), octagonal (D), and dumbbell-shaped (E) diaphragms are used and piezoelectric elements having substantially the same areas are disposed at the center thereof.

FIGS. 8(A) and (B) illustrate changes in the frequency characteristics of the piezoelectric acoustic component when the shape and dimensions of the piezoelectric element are changed.

EMBODIMENTS FOR CARRYING OUT THE INVENTION

Embodiments of a piezoelectric acoustic component according to the invention will be described below with reference to the drawings.

First Embodiment

Figure 1A:
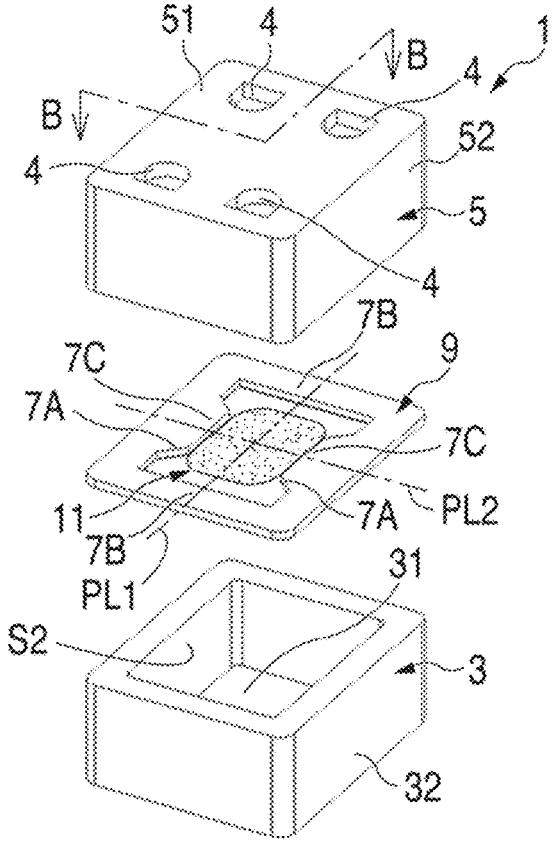
FIG. 1 (A) is an exploded perspective view illustrating a piezoelectric acoustic component including a piezoelectric sounding element according to an embodiment and FIG. 1 (B) is an exploded perspective view taken along line B-B in FIG. 1(A).
Figure 1B:
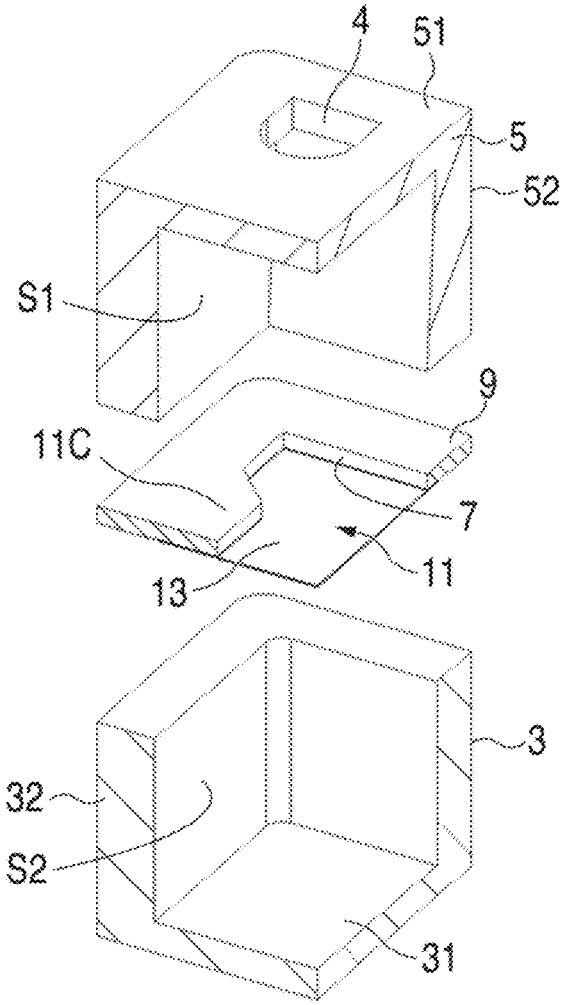
Figure 2:
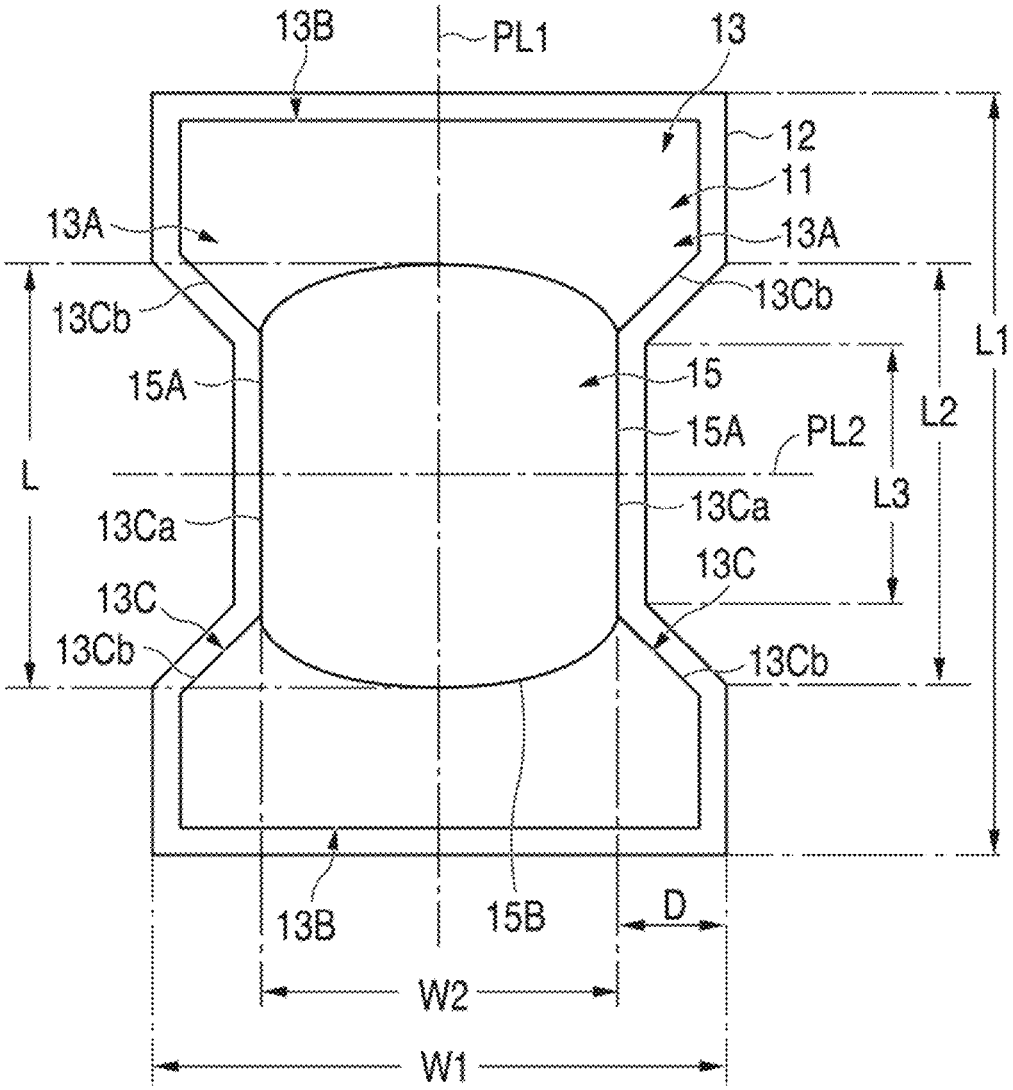
FIG. 2 is a plan view illustrating the piezoelectric sounding element.

FIG. 1(A) is an exploded perspective view illustrating a piezoelectric acoustic component 1 including a piezoelectric sounding element according to the embodiment and FIG. 1(B) is an exploded perspective view taken along line B-B in FIG. 1(A). FIG. 2 is a plan view illustrating the piezoelectric sounding element. It should be noted here that the thicknesses of some components are emphasized to make understanding easier in the embodiment. The piezoelectric acoustic component 1 illustrated in FIGS. 1(A) and (B) is used to emit an alarm using sound of multiple musical scales in a noisy environment such as, for example, a vehicle interior.

The piezoelectric acoustic component 1 includes a case 6 having a sounding element holder 9 with an opening 7 between a case lower half 3 and a case upper half 5. The case lower half 3 is integrally formed of insulating resin such as polypropylene etc. and includes a rectangular bottom wall portion 31 and a peripheral wall portion 32 uprising from a peripheral edge of the bottom wall portion 31. The case lower half 3 includes the rectangular bottom wall portion 31 and the peripheral wall portion 32 uprising from a peripheral edge of the bottom wall portion 31. The case upper half 5 integrally formed of insulating resin such as polypropylene etc. and includes a rectangular top wall portion 51 and the peripheral wall portion 32 uprising from a peripheral edge of the top wall portion 51. The case upper half 5 includes the rectangular top wall portion 51 and a peripheral wall portion 52 falling from a peripheral edge of the top wall portion 51. Four sound emission holes 4 are formed near the four corners of the top wall portion 51.

The sounding element holder 9 integrally formed of low-thermal-expansive and hard insulating resin such as, for example, insulating resin in which glass is added to polybutylene terephthalate, and a diaphragm 12 of a piezoelectric sounding element 11 is fixed to the periphery of the opening 7 via an adhesive. The opening 7 has the same shape as the contour shape of a non-fixed portion 13 of the diaphragm 12 of the piezoelectric sounding element, which will be described in detail later. Specifically, the non-fixed portion 13 of the diaphragm 12 includes a pair of long sides 7A facing each other, a pair of short sides 7B, shorter than the long sides 7A, that face each other, and a pair of protrusions 7C, provided in the pair of long sides 7A, that protrude so as to approach each other. The contour shape of the opening 7, that is, the contour shape of the non-fixed portion 13 of the diaphragm 12, is symmetric with respect to a first imaginary line PL1 that bisects the pair of short sides 7B and symmetric with respect to a second imaginary line PL2 that bisects the pair of long sides 7A.

The case lower half 3, the sounding element holder 9, and the case upper half 5 are closely joined to each other via ultrasonic welding while the sounding element holder 9 is sandwiched between the peripheral wall portion 32 and the peripheral wall portion 52 to complete the case 6. This forms a first space S1 and a second space S2 on both sides of the piezoelectric sounding element in the case 6 while the piezoelectric sounding element 11 is fixed to the sounding element holder 9. The sound emission holes 4 communicate with the first space S1. The first space S1 forms the air chamber of a resonator.

As illustrated in FIG. 2, the piezoelectric sounding element 11 includes the metal diaphragm 12 and a piezoelectric element 15 provided on at least one surface of the diaphragm 12. The non-fixed portion of the diaphragm 12 includes a pair of long sides 13A that face each other, a pair of short sides 13B, shorter than the long sides 13A, that face each other, and a pair of recesses 13C, provided in the pair of long sides 13A, that protrude so as to approach each other. The piezoelectric element 15 is provided in a region between the pair of recesses 13C of the diaphragm 12 and the contour shapes of the non-fixed portion 13 and the piezoelectric element 15 of the diaphragm 12 are defined so as to be symmetrical with respect to the first imaginary line PL1 that bisects the pair of short sides 13B and symmetrical with respect to the second imaginary line PL2 that bisects the pair of long sides 13A. The recesses 13C may have any shape. Each of the recesses 13C of the embodiment includes a parallel straight line portion 13Ca extending in parallel with the first imaginary line PL1 and a pair of inclined straight line portions 13Cb extending away from the both ends of the parallel straight line portion 13Ca to the corresponding remaining portions of the long sides 13A. In this case, the outline of the piezoelectric element 15 has a pair of straight line portions 15A along the parallel straight line portions 13Ca of the pair of recesses 13C and curved portions 15B curved so as to protrude toward the pair of short sides 13B in regions sandwiched between the pair of inclined straight line portions 13Cb of the pair of recesses 13C facing each other in the direction in which the second imaginary line PL2 extends. The frequency difference between the primary resonance frequency and the tertiary resonance frequency can be adjusted by changing the curvature of the curved portion 15B of the piezoelectric element 15 as appropriate.

In the embodiment, the shape of the non-fixed portion 13 of the diaphragm 12 is defined so that ratio L1/W1 of length L1 of the long sides to length W1 of the short sides is defined so as to fall within a range from 1.25 to 1.75 and a resonator having one or more sound emission holes is defined so that the sound pressure at an intermediate frequency between the primary resonance frequency and the tertiary resonance frequency when a sinusoidal signal is input as an input signal is equal to or higher than the sound pressure at the primary resonance frequency and the sound pressure at the tertiary resonance frequency. As described later, any number of sound emission holes may be provided.

[Frequency Characteristics in the Embodiment]

Figure 3A:
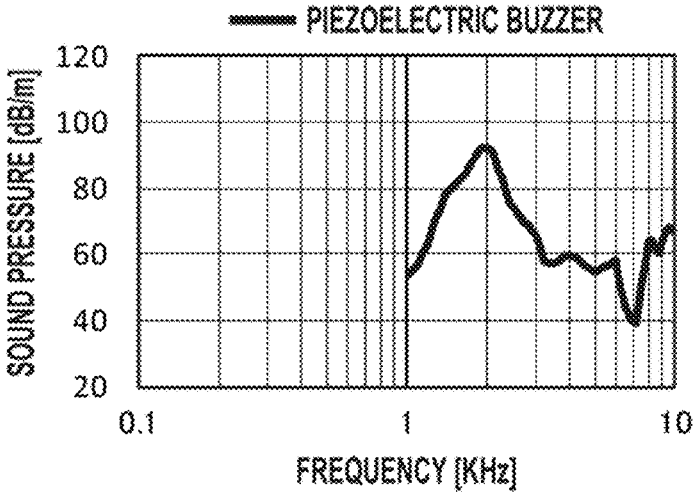
FIG. 3(A) illustrates an example of the frequency characteristics of a piezoelectric acoustic component including an existing discoid diaphragm, which is referred to as a piezoelectric buzzer.
Figure 3B:
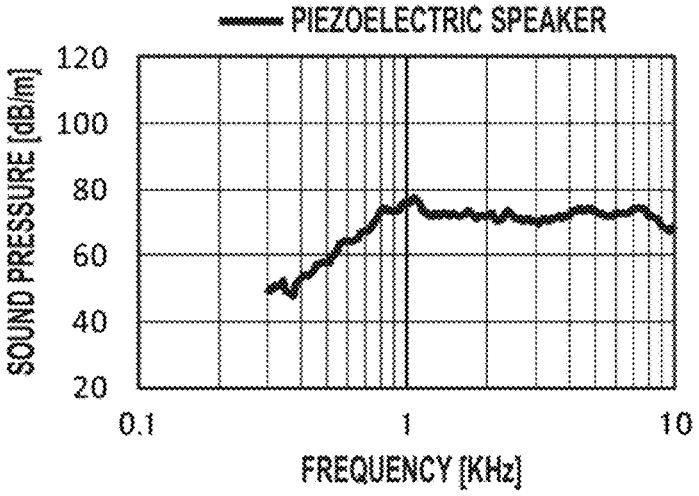
FIG. 3(B) illustrates an example of the frequency characteristics of a piezoelectric acoustic component including a rectangular diaphragm, which is referred to as a piezoelectric speaker as described in Patent Literature 1.
Figure 3C:
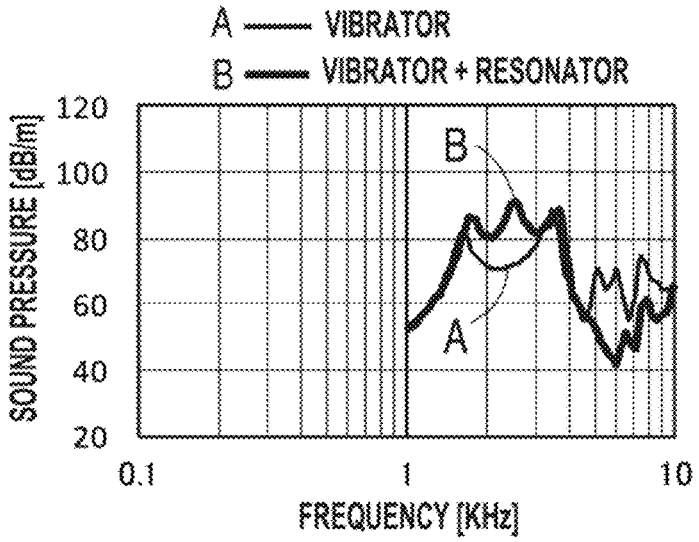
FIG. 3(C) illustrates an example of the frequency characteristics of the piezoelectric acoustic component according to the embodiment.
Figure 5A:
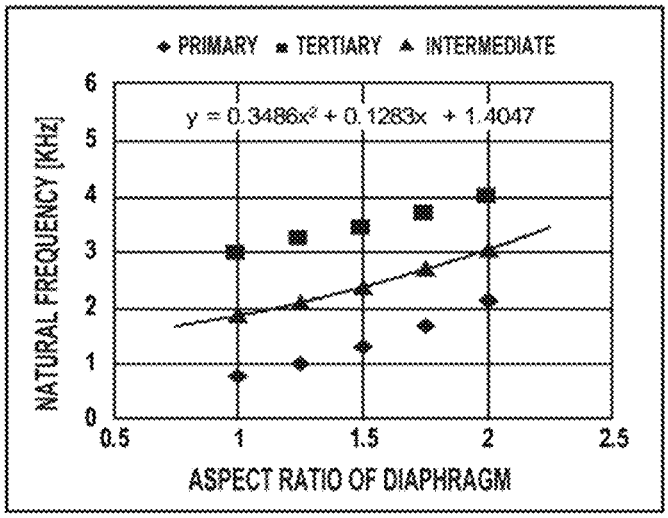
FIGS. 5(A) to (E) illustrate the measurement results of the primary resonance frequency, the tertiary resonance frequency, and the intermediate frequency when the aspect ratio is changed.
Figure 5B:
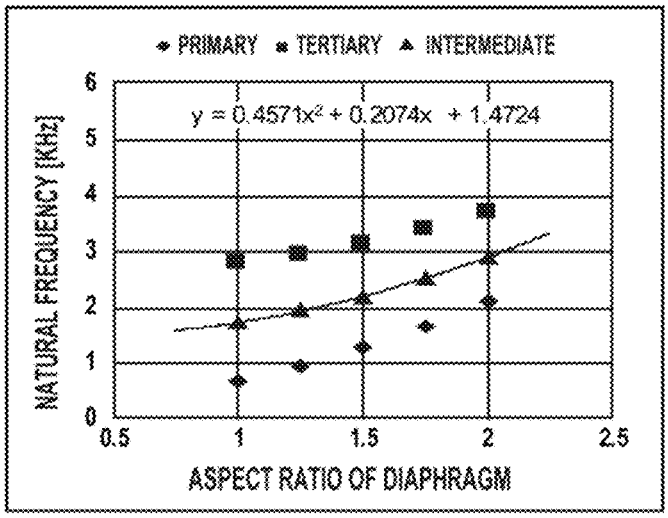
Figure 5C:
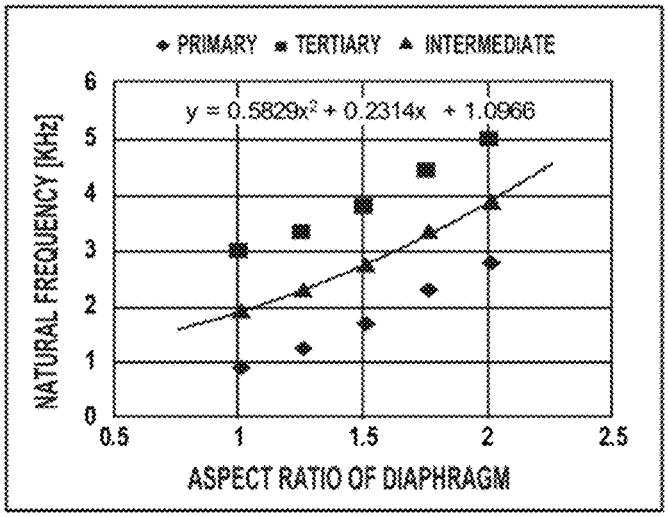
Figure 5D:
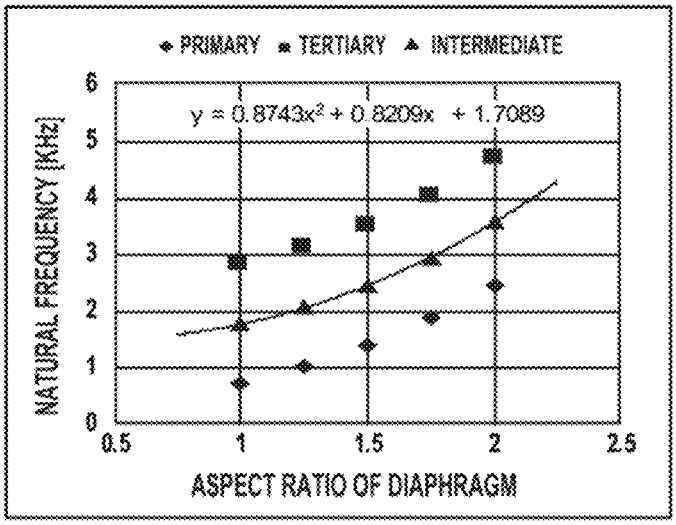
Figure 5E:
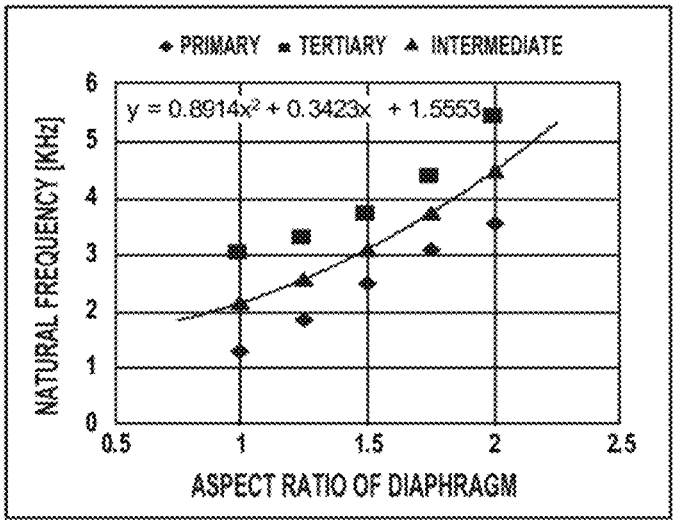

FIG. 3(A) illustrates an example of the frequency characteristics when a sinusoidal signal is input as an input signal to a piezoelectric acoustic component including a non-fixed portion of an existing discoid diaphragm, which is referred to as a piezoelectric buzzer. As is clear from this drawing, the piezoelectric buzzer only needs to have a high sound pressure (90 dB or more in this example) at one resonance frequency. In contrast, FIG. 3(B) illustrates an example of the frequency characteristics of a piezoelectric acoustic component including a rectangular diaphragm, which is referred to as a piezoelectric speaker as described in Patent literature 1. FIG. 3(C) illustrates an example of the frequency characteristics of the piezoelectric acoustic component according to the embodiment.

As illustrated in FIG. 3(B), the piezoelectric speaker including the non-fixed portion of the rectangular diaphragm also needs to have a flat sound pressure across a wide frequency range (seventies sound pressure in this example). As in the embodiment, the piezoelectric acoustic component 1 including the metal diaphragm 12 of a so-called rectangular shape cannot easily obtain a certain level of sound pressure in a predetermined frequency range as the piezoelectric speaker in FIG. 3(B) [frequency characteristics graph A in FIG. 3(C) indicates the case in which only the piezoelectric sounding element is used].

The inventors have found that, when using the diaphragm 12 having the recesses 13C in the pair of long sides 13A of the non-fixed portion 13 as in the embodiment, the sound pressure at the primary resonance frequency and the frequency at the tertiary resonance frequency when a sinusoidal signal is input as an input signal does not become so high and the frequency characteristics in which the sound pressures at the resonance frequencies are 80 dB or more can be obtained. The inventors also have found that, if the predetermined sound emission holes 4 are provided in the case 6, the sound pressure at the intermediate frequency region between the primary resonance frequency and the tertiary resonance frequency when a sinusoidal signal is input as an input signal can be increased [see frequency characteristics graph B in FIG. 3(C)]. According to the embodiment, a sound pressure of 80 dB or more can be obtained across the frequency range of multiple musical scales [approximately 1.7 kHz to approximately 3.6 kHz in the example in (C) of FIG. 3]. As a result, according to the embodiment, it is possible to provide a piezoelectric acoustic component capable of emitting audible sound in a predetermined frequency range even in a noisy place by using the piezoelectric sounding element including the metal diaphragm of a so-called rectangular shape.

[Identifying the Shape of the Non-Fixed Portion of a Diaphragm]

The reason why the shape of the non-fixed portion 13 of the diaphragm 12 is identified in the above embodiment will be described below. FIG. 4 illustrates the shapes of the non-fixed portion of the diaphragms, the regions of sections of vibrations, and the measurement results of the frequencies of the primary resonance frequency and the tertiary resonance frequency in the case where the aspect ratio (ratio between the long axis or the long side and the short axis or the short side) is changed when oval (such as circular or elliptic) (A), rectangular (B), hexagonal (C), octagonal (D), and dumbbell-shaped (E) (shape having a pair of recesses in a pair of long sides as in the embodiment) non-fixed portions of the diaphragms are used and piezoelectric elements having substantially the same areas are disposed at the center thereof.

Figure 6:
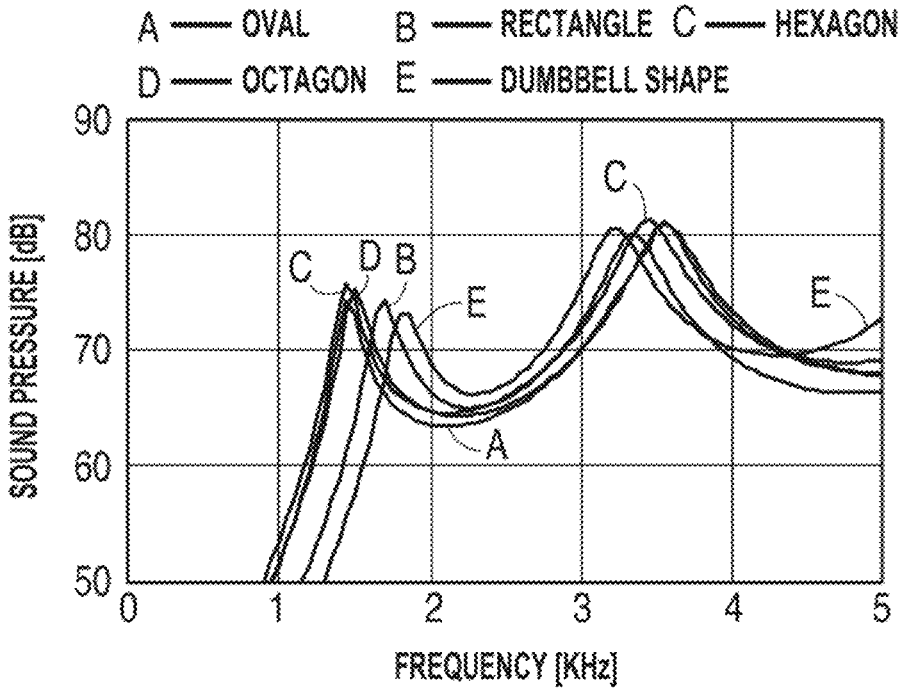
FIG. 6 illustrates the frequency characteristics obtained when only the piezoelectric sounding element is used in the case where oval (such as circular or elliptic) (A), rectangular (B), hexagonal (C), octagonal (D), and dumbbell-shaped (E) diaphragms having the same aspect ratio are used.

In the rightmost column in FIG. 4, the shape of the piezoelectric element having an aspect ratio of 1:1.5 is indicated as a reference example. In addition, FIGS. 5(A) to (E) illustrate the measurement results of the primary resonance frequency (♦), the tertiary resonance frequency (■), and the intermediate frequency (▲) in the case where a sinusoidal signal is input as an input signal when the aspect ratio is changed. It should be noted here that the intermediate frequency represents the frequency at which the sound pressure can be increased by providing sound emission holes as in the above embodiment. As is clear by comparison between FIGS. 5(A) to (E), use of the non-fixed portion of the dumbbell-shaped diaphragm adopted in the embodiment makes the primary resonance frequency and the tertiary resonance frequency high and the difference between the primary resonance frequency and the tertiary resonance frequency small. In addition, FIG. 6 illustrates the frequency characteristics obtained when only the piezoelectric sounding element is used in the case where oval (such as circular or elliptic) (A), rectangular (B), hexagonal (C), octagonal (D), and dumbbell-shaped (E) diaphragms having the same aspect ratio are used. As is clear from FIG. 6, the difference between the primary resonance frequency and the tertiary resonance frequency can be minimized in the dumbbell-shaped (E) diaphragm. Accordingly, the dumbbell-shaped (E) diaphragm adopted in the embodiment can be identified to be the preferable contour shape of the non-fixed portion of the diaphragm.

[Modifications of the Recesses of the Non-Fixed Portion 13 of the Diaphragm 12]

FIGS. 7 (A) to (D) illustrate the test results of changes of the difference Δ between the primary resonance frequency and the tertiary resonance frequency for the same aspect ratio (1:1.3) when the shape of recesses of the non-fixed portion 13 of the diaphragm 12 is different. The recesses 13C in FIG. 7(A) are the same as in the above embodiment.

Figure 7A:
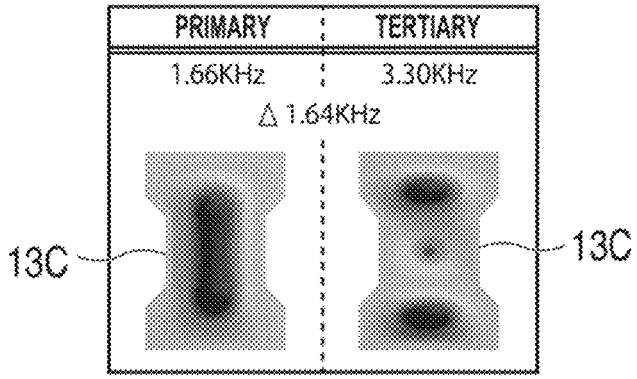
FIGS. 7(A) to (D) illustrate the investigation results of changes in the difference Δ between the primary resonance frequency and the tertiary resonance frequency for the same aspect ratio (1:1.3) when the shape of the recesses is different.
Figure 7B:
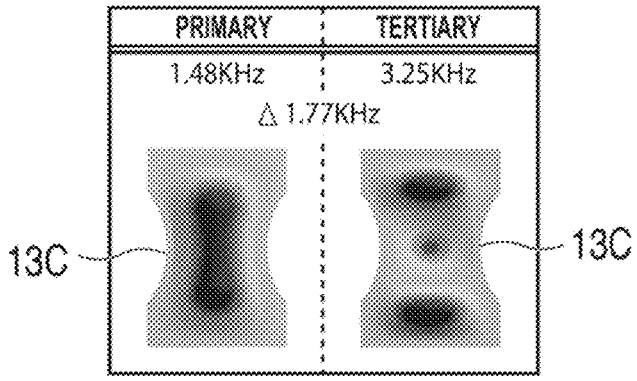

FIG. 7(B) indicates the case in which the recesses 13C of the non-fixed portion 13 of the diaphragm 12 are formed by curved recesses curved so as to protrude toward the second imaginary line and the outline of the piezoelectric element (not illustrated) includes curved portions curved so as to protrude toward a pair of short sides in a region sandwiched between the pair of curved recesses along the pair of curved recesses.

Figure 7C:
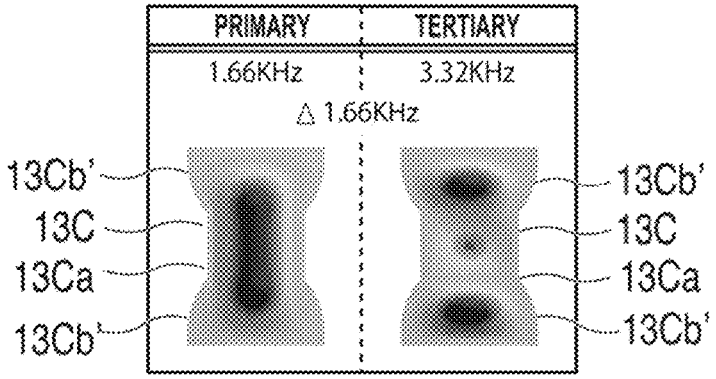
Figure 7D:
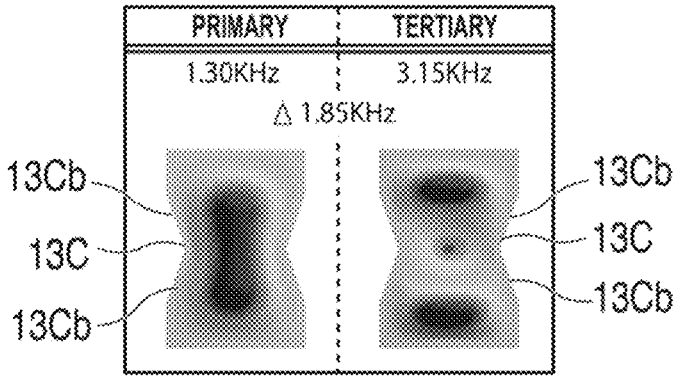

Each of the recesses 13C of the non-fixed portion 13 of the diaphragm 12 in FIG. 7(C) includes the parallel straight line portion 13Ca extending in parallel with the second imaginary line and a pair of protruding curved portions 13Cb' away from both end portions of the parallel straight line portion 13Ca so as to protrude toward the inside of the recesses 13C. Also in this case, the outline of the piezoelectric element (not illustrated) includes a pair of straight line portions along the parallel straight line portions 13Ca of the pair of recesses 13C and curved portions curved so as to protrude toward the pair of short sides in a region sandwiched between the pair of protruding curved recesses 13Cb' of the pair of recesses. Also in this case, the frequency difference between the primary resonance frequency and the tertiary resonance frequency can be adjusted by changing the curvature of the curve of the piezoelectric element as appropriate.

[Shape of the Piezoelectric Element]

FIGS. 8(A) and (B) of illustrate changes in the frequency characteristics in the case where a sinusoidal signal is input as an input signal when the shape and dimensions of the piezoelectric element 15 are changed. FIG. 8 (A) illustrates changes in the frequency characteristics when the aspect ratio 1 of the diaphragm 12 is 1:1.3, the width (dimension along the second imaginary line PL2) of the piezoelectric element (PZT ceramic) is constantly 13 mm, and the length (protrusion length of the curved portions 15B in FIG. 2) along the first imaginary line PL1 is changed. FIG. 8 (B) illustrates changes in the frequency characteristics when the shape of the piezoelectric element is rectangular, the aspect ratio 1 of the diaphragm 12 is 1:1.3, the width (dimension along the second imaginary line PL2) of the piezoelectric element (PZT ceramic) is constantly 13 mm, and the length along the first imaginary line PL1 is changed. It can be seen from (A) and (B) of FIG. 8 that the length and the shape along the first imaginary line PL1 have effects on the sound pressures of the first resonance frequency and the second resonance frequency. In the lower regions of FIGS. 8 (A) and (B), plan views of the piezoelectric sounding elements (a) to (j) that indicate the shapes of the target piezoelectric elements are shown. It can be seen from FIGS. 8(A) and (B) that the sound pressures of the primary resonance frequency and the tertiary resonance frequency increases when the length along the first imaginary line PL1 becomes large, but the difference between the sound pressures of the primary resonance frequency and the sound pressures of the tertiary resonance frequency becomes extremely high when the length is too large. This tendency is accelerated when the shape of the piezoelectric element along the first imaginary line PL1 is completely rectangular (FIG. 8(B)). The shape of the piezoelectric element may be determined in consideration of such tendency.

Figure 9:
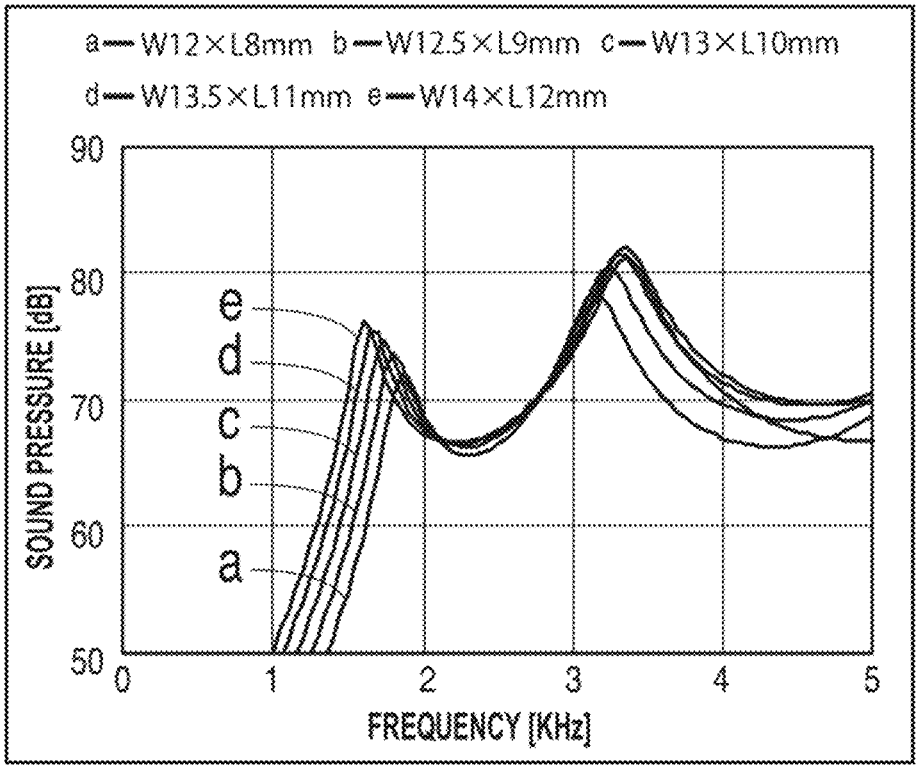
FIG. 9 illustrates the frequency characteristics in the case where width W and length L of the piezoelectric element are changed when the aspect ratio is larger (1:1.4) than in FIG. 8.

FIG. 9 illustrates the frequency characteristics with respect to changes in width W2 (dimension along the second imaginary line 2) and length L (dimension along the first imaginary line 1) of the piezoelectric element in the case where a sinusoidal signal is input as an input signal when the aspect ratio is larger (1:1.4) than in FIG. 8. As is clear by comparison between FIG. 8 and FIG. 9, although the difference between the sound pressure at the primary resonance frequency and the sound pressure at the tertiary resonance frequency is increased when the aspect ratio is increased, the difference between the sound pressure at the primary resonance frequency and the sound pressure at the tertiary resonance frequency is not increased when the length of the piezoelectric element is increased and large variations are not caused in a high frequency range. In practice, the shape and dimensions of the piezoelectric element are adjusted as appropriate in consideration of the tendency that can be seen in FIGS. 8 and 9.

[Effects of the Resonator (Sound Emission Holes of the Case)]

Figure 10:
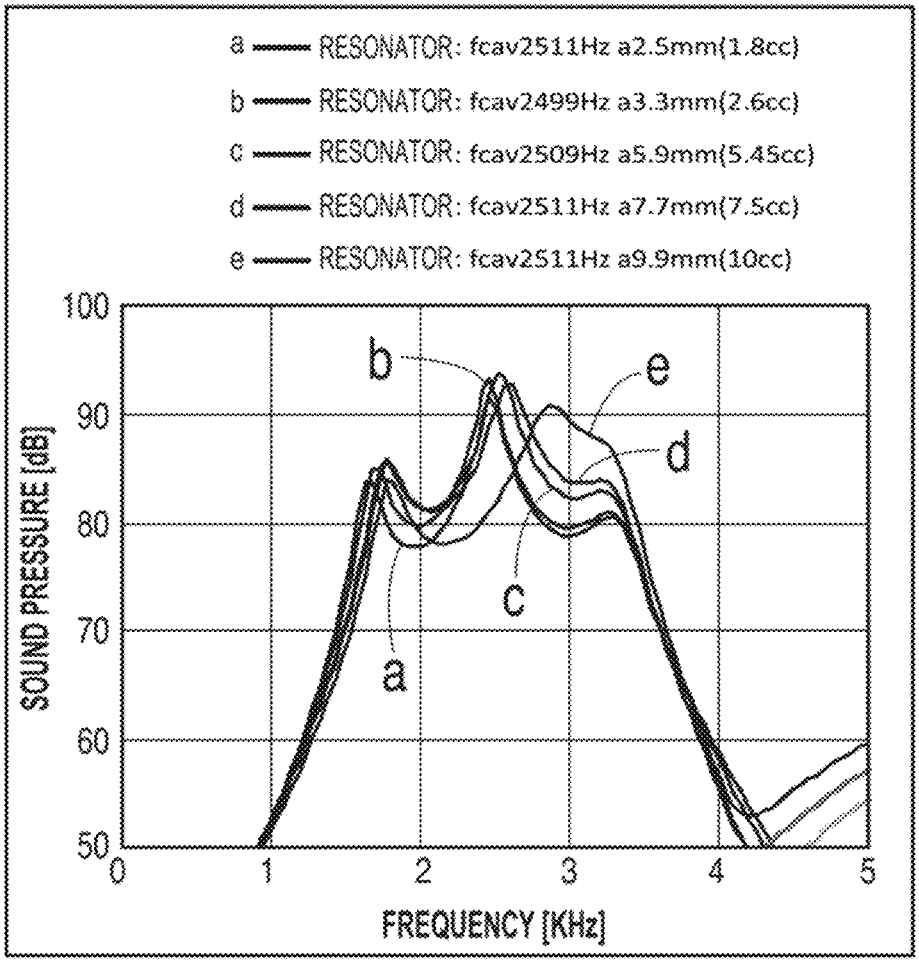
FIG. 10 illustrates an example of the test results of changes in the frequency characteristics when the total opening area of sound emission holes of a resonator is changed.
Figure 11:
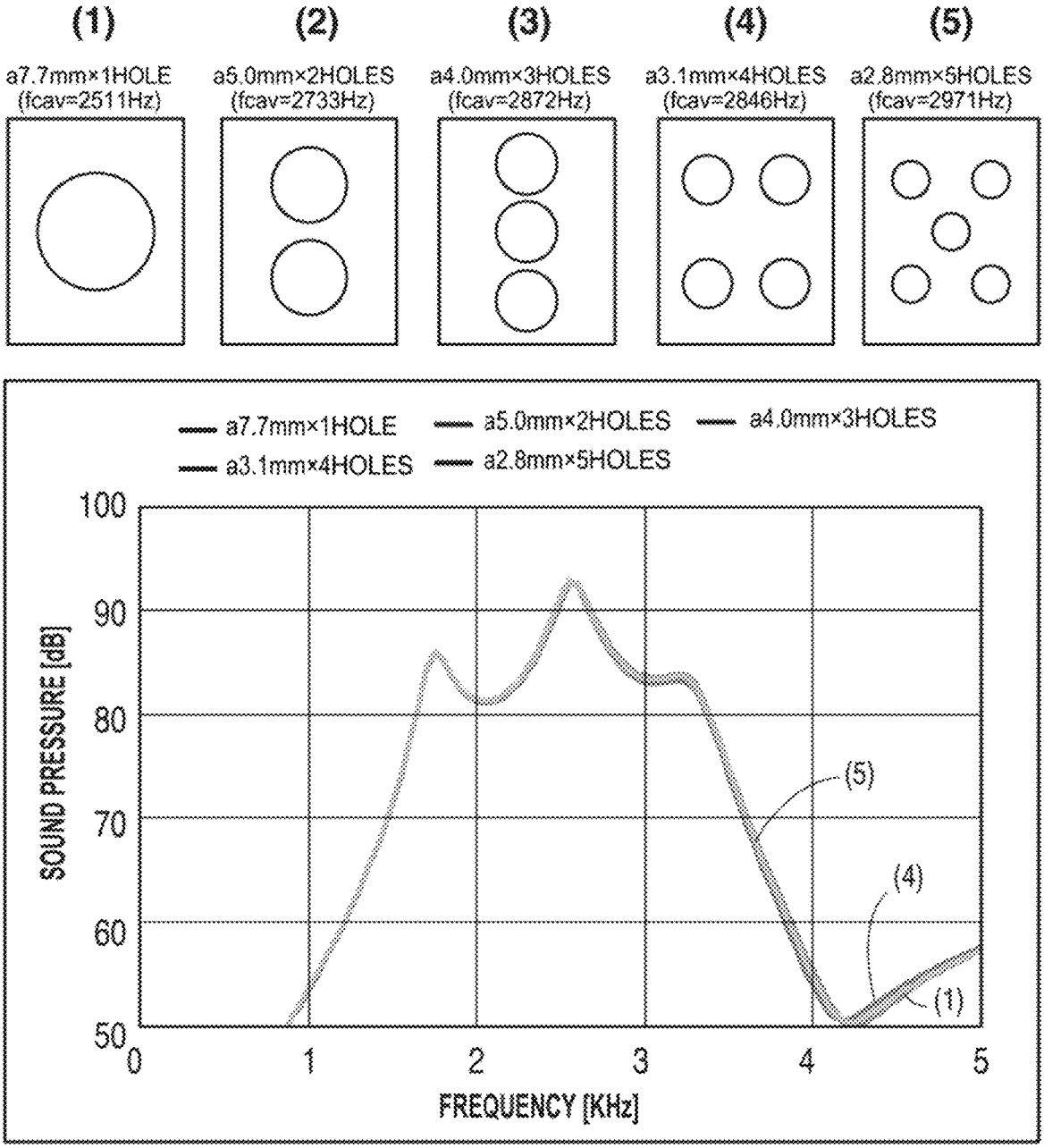
FIG. 11 illustrates the test results of the effects of changes in the number of sound emission holes from one to five when the total opening area of the sound emission holes is changed little.

FIG. 10 illustrates the test results of changes in the frequency characteristics in the case where a sinusoidal signal is input as an input signal when the total opening area of sound emission holes of the resonator is changed from 1.8 cc to 10 cc using the volume (air chamber capacity of the resonator) of a front cavity in the embodiment as an example. It should be noted here that the aspect ratio of the diaphragm is 1:1.3, the shape of the piezoelectric element is oval, the width is 10 mm, and the length is 15 mm constantly in this test. Another emission hole is provided to change the total opening area of sound emission holes in this state, and the diameter thereof is changed in the range from 2.5 mm to 9.9 mm so as to correspond to the volume of the front cavity. It should be noted here that $f_{cav}$ indicates the value of the intermediate frequency in FIG. 10. It can be seen from FIG. 10 that the value of the intermediate frequency does not change greatly and a large difference is not caused in the sound pressure at the intermediate frequency if the total opening area of sound emission holes falls within an appropriate range when the total opening area is too large (case e). In addition, FIG. 11 illustrates the test results of the effects of changes in the number of sound emission holes from one to five while changing the total opening area of the sound emission holes little. Since the difference between the sound pressure at the primary resonance frequency and the sound pressure at the tertiary resonance frequency is minimized and the frequency characteristics having a high sound pressure can be obtained when the volume of the front cavity is 7.5 cc, the volume of the front cavity is set to 7.5 cc. The test conditions other than the number of sound emission holes are the same as the test in FIG. 10. It can be seen from FIG. 11 that the number of sound emission holes does not have effects on the frequency characteristics when the total opening area is not changed. Accordingly, it can be seen from the results that the number of sound emission holes is preferably one or more. The results have been obtained in the embodiment and not necessarily true in all cases in which the structure of the resonator is changed.

Conditions of the Examples

The piezoelectric sounding elements and the resonators (cases and sound emission holes) used in the above tests meet the following conditions. The non-fixed portion 13 of the diaphragm 12 is preferably formed by an alloy plate having a thickness of 10 μm to 150 μm in which iron is mixed with nickel. In addition, each of the piezoelectric elements preferably has a structure in which a plurality of PZT ceramic layers each having a thickness of 10 μm to 35 μm is laminated with each other. In addition, an acrylic adhesive for bonding the piezoelectric element to the diaphragm preferably has a Shore D hardness of 75 to 85 and a thickness of 1 μm to 10 μm.

Second Embodiment

Figure 12A:
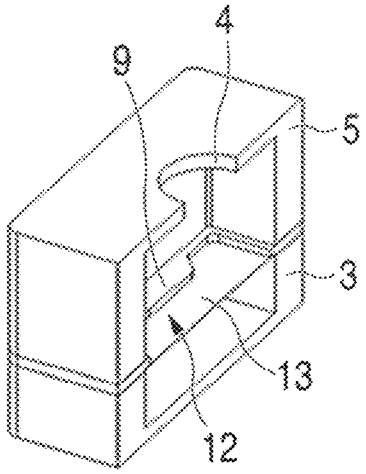
FIG. 12(A) is a sectional perspective view illustrating a half portion of a piezoelectric acoustic component according to a second embodiment and FIG. 12(B) is an exploded perspective view illustrating this half portion.
Figure 12B:
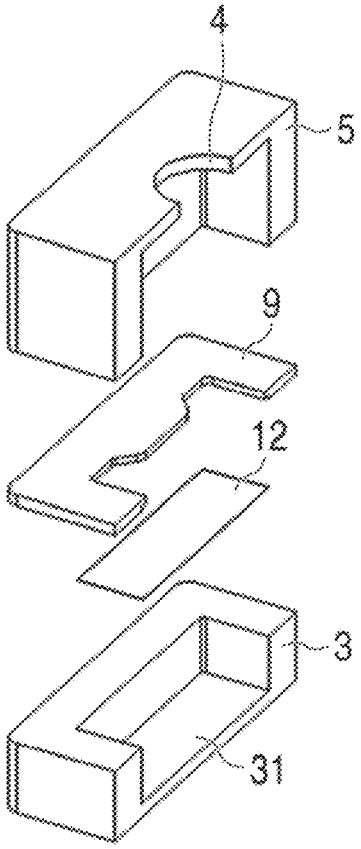
Figures 13A, 13B:
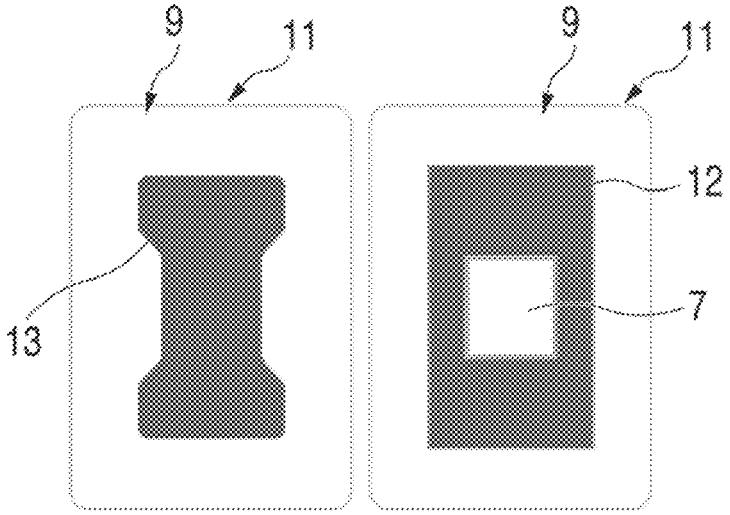
FIG. 13(A) is a plan view illustrating a piezoelectric sounding element used in the second embodiment and FIG. 13(B) is a rear view illustrating the piezoelectric sounding element.

FIGS. 12 (A) and (B) are a sectional perspective view and an exploded perspective view that illustrate half portions of the piezoelectric acoustic component 1 according to a second embodiment, FIG. 13(A) is a plan view illustrating the piezoelectric sounding element 11 used in the second embodiment, and FIG. 13(B) is a rear view illustrating the piezoelectric sounding element. The second embodiment is different from the first embodiment illustrated in FIGS. 1 and 2 in the shape of the piezoelectric sounding element 11 and the positions and the number of the sound emission holes 4. The other points are the same as in the first embodiment. Accordingly, in FIGS. 12 and 13, the same components as in the first embodiment illustrated in FIG. 1 and FIG. 2 are denoted by the same reference numerals used for describing FIG. 1 and FIG. 2 to omit descriptions. In the embodiment, the diaphragm 12 of the piezoelectric sounding element 11 is rectangular and the piezoelectric element 15 is pasted to the back surface of the diaphragm 12. The contour shape of the non-fixed portion 13 of the diaphragm 12 is also so-called dumbbell-shaped in the embodiment.

Figure 14A:
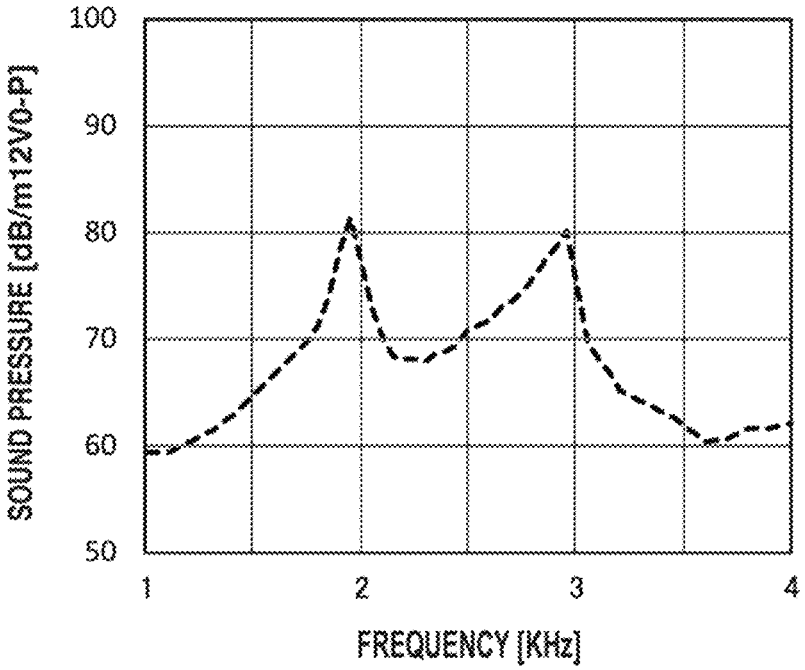
FIG. 14(A) illustrates the frequency characteristics with respect to the sound pressure measured when using only the piezoelectric sounding element without using a sympathetic unit and FIG. 14(B) illustrates the frequency characteristics with respect to the sound pressure of the piezoelectric acoustic component measured when using the sympathetic unit.
Figure 14B:
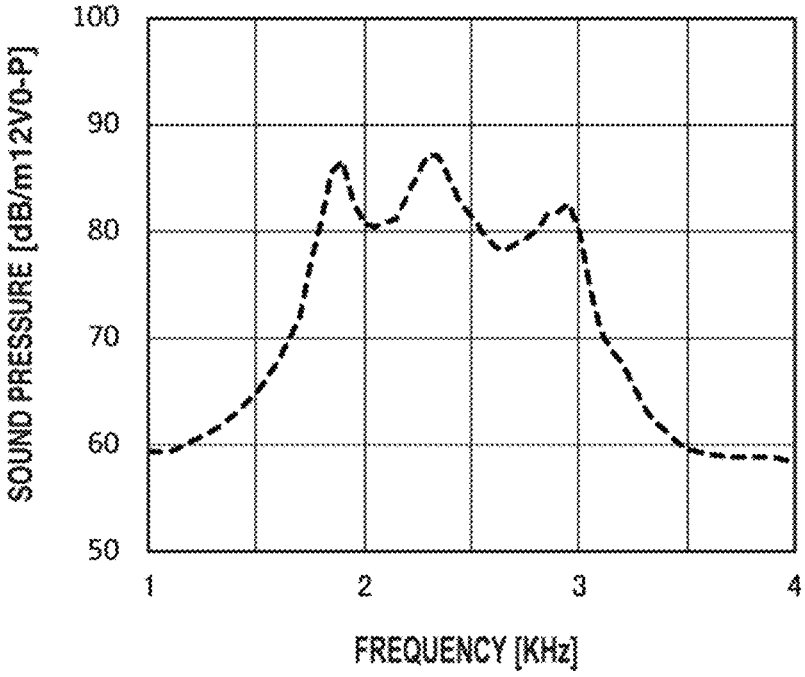

In this structure, special processing does not need to be applied to the diaphragm 12. In addition, one sound emission hole 4 is formed at the center of the top wall portion 51 of the case upper half 5 in the embodiment. FIG. 14 (A) illustrates the frequency characteristics with respect to the sound pressure measured when using only the piezoelectric sounding element 11 without using a sympathetic unit (case lower half 3) and of FIG. 14(B) illustrates the frequency characteristics with respect to the sound pressure of the piezoelectric acoustic component measured when using the sympathetic unit. As is clear by comparison between FIGS. 14 (A) and 14 (B), the sound pressure is increased in the range from 1.7 kHz to 3 kHz.

[Modification of the Shape of the Non-Fixed Portion of the Diaphragm]

Figures 15A, 15B:
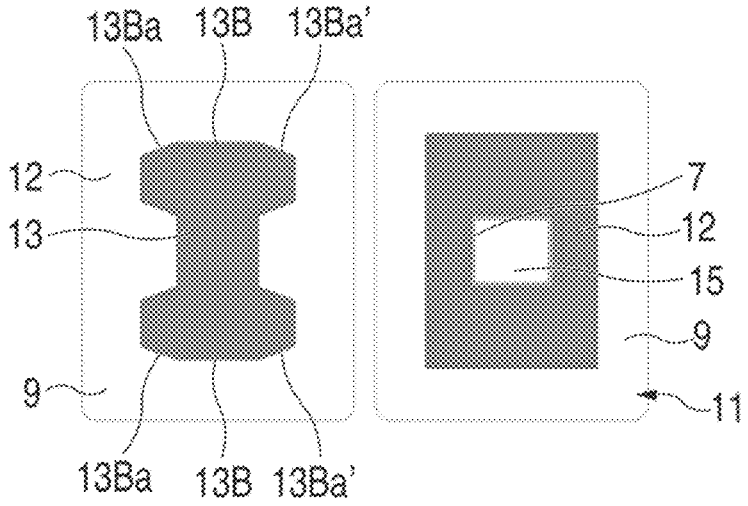
FIGS. 15(A) and (B) are a plan view and a rear view that illustrate a modification of the piezoelectric sounding element used in the second embodiment.
Figure 16A:
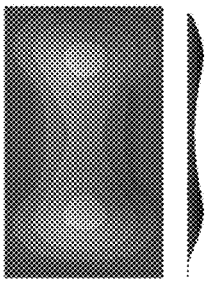
FIGS. 16(A) to (D) illustrate the vibration state of a piezoelectric vibration element that vibrates in different vibration modes.
Figure 16B:
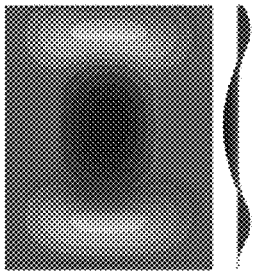
Figure 16C:
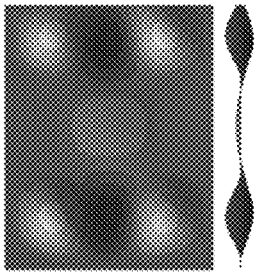
Figure 16D:
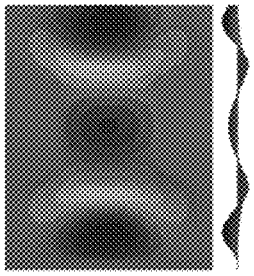
Figure 17A:
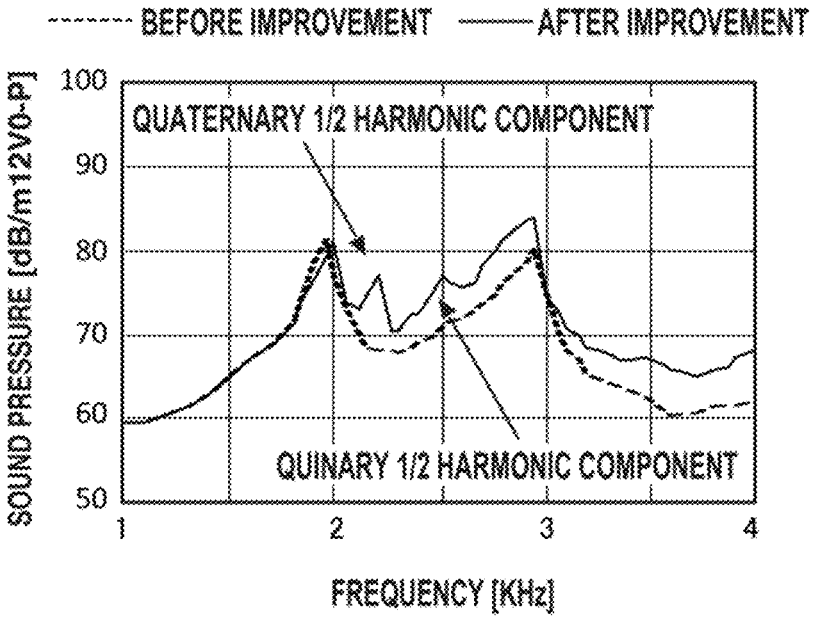
FIG. 17(A) illustrates the frequency characteristics with respect to the sound pressure measured when using only the piezoelectric sounding element without using the sympathetic unit and FIG. 17(B) illustrates the frequency characteristics with respect to the sound pressure of the piezoelectric acoustic component measured when using the sympathetic unit.
Figure 17B:
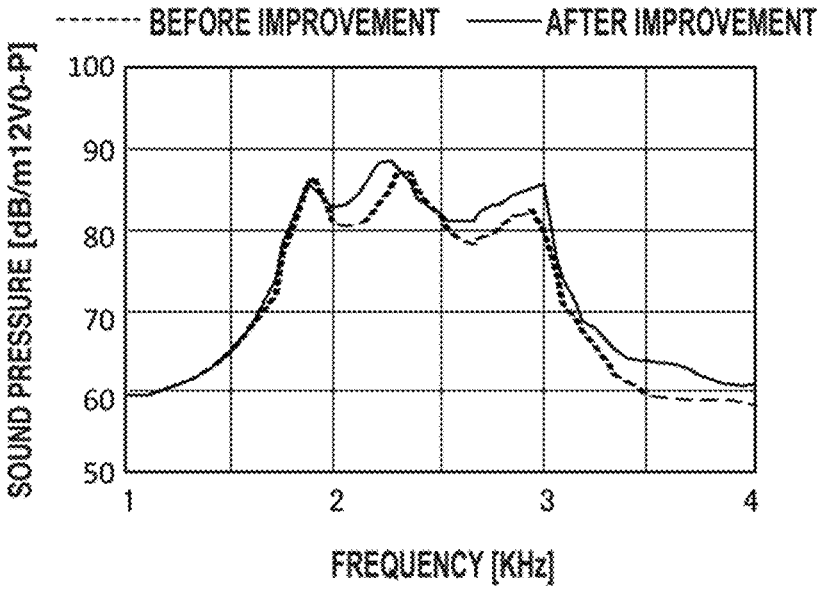

FIGS. 15(A) and 15(B) illustrate a modification of the piezoelectric sounding element 11 used in the second embodiment. In the contour shape of the dumbbell-shaped non-fixed portion 13 of the diaphragm 12 of this piezoelectric sounding element 11, the pair of short sides 13B has, in both end portions, a pair of inclined portions 13Ba inclined so as to approach each other. Provision of the pair of inclined portions 13Ba can achieve improvement increasing harmonic components of the frequency characteristics by changing the inclination angle of the inclined portion 13Ba. That is, adoption of this shape of the piezoelectric sounding element 11 can achieve improvement increasing the sound pressure of the frequency part indicated by the arrow in A of FIG. 17. FIGS. 16(A) to (D) illustrate the vibration states of the diaphragm 12 when the piezoelectric sounding element is vibrated in a primary vibration mode, when the piezoelectric sounding element is vibrated in a tertiary vibration mode, when the piezoelectric sounding element is vibrated in a quaternary vibration mode, and when the piezoelectric sounding element is vibrated in a quinary vibration mode. In these diagrams, white parts are deformed protrusions and black parts are deformed recesses. FIG. 17(A) illustrates the frequency characteristics with respect to the sound pressure measured when using only the piezoelectric sounding element 11 without using the sympathetic unit (case lower half 3) and FIG. 17(B) illustrates the frequency characteristics with respect to the sound pressure measured when using the sympathetic unit. As is clear by comparison between FIGS. 14 (A) and (B), the sound pressure is higher in the range from 1.7 kHz to 3 kHz than before improvement.

Third Embodiment

Figures 18A, 18B:
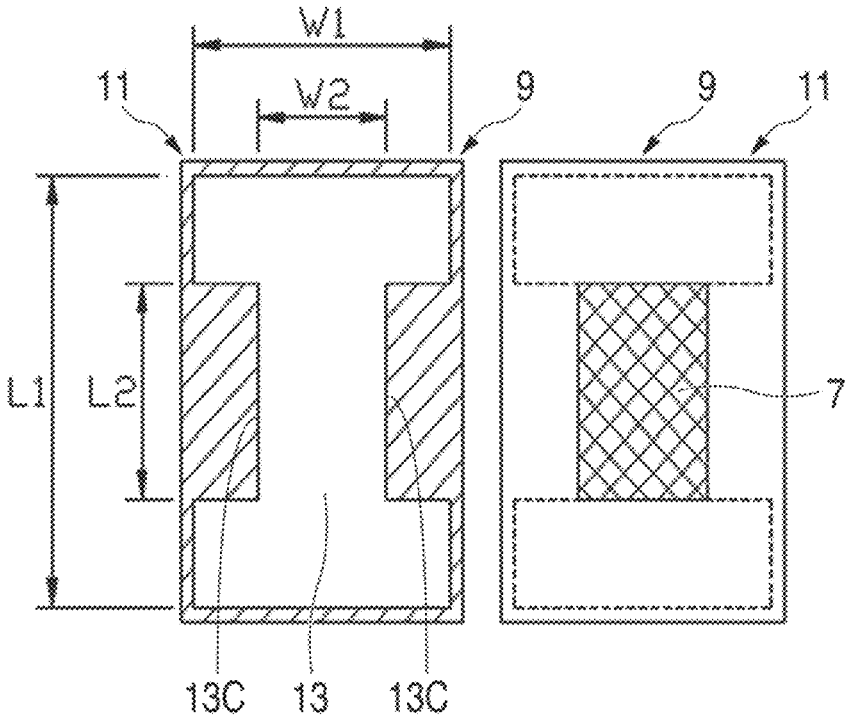
FIGS. 18 (A) and (B) are a plan view and a rear view of a piezoelectric sounding element used in a piezoelectric acoustic component according to a third embodiment.

FIGS. 18(A) and (B) are a plan view and a rear view of the piezoelectric sounding element 11 used in the piezoelectric acoustic component according to a third embodiment. The third embodiment is different from the second embodiment illustrated in FIGS. 12 and 13 in the shape of the piezoelectric sounding element 11. The other points are the same as in the second embodiment. Accordingly, in FIG. 18, the same components as in the second embodiment illustrated in FIGS. 12 and 13 are denoted by the same reference numerals used for describing FIGS. 12 and 13 to omit descriptions. Also in this embodiment, the diaphragm 12 of the piezoelectric sounding element 11 is rectangular and the piezoelectric element 15 is pasted to the back surface of the diaphragm 12. In the embodiment, the contour shape of the non-fixed portion 13 of the diaphragm 12 has a so-called dumbbell shape that does not include the inclined straight line portions of the non-fixed portions 13 of the diaphragms in the first embodiment and the second embodiment. That is, the recesses 13C are completely rectangular. In this structure, special processing does not need to be applied to the diaphragm 12. In addition, in the embodiment, one sound emission hole is formed at the center of the top wall portion of the case upper half as in the second embodiment.

Figure 19:
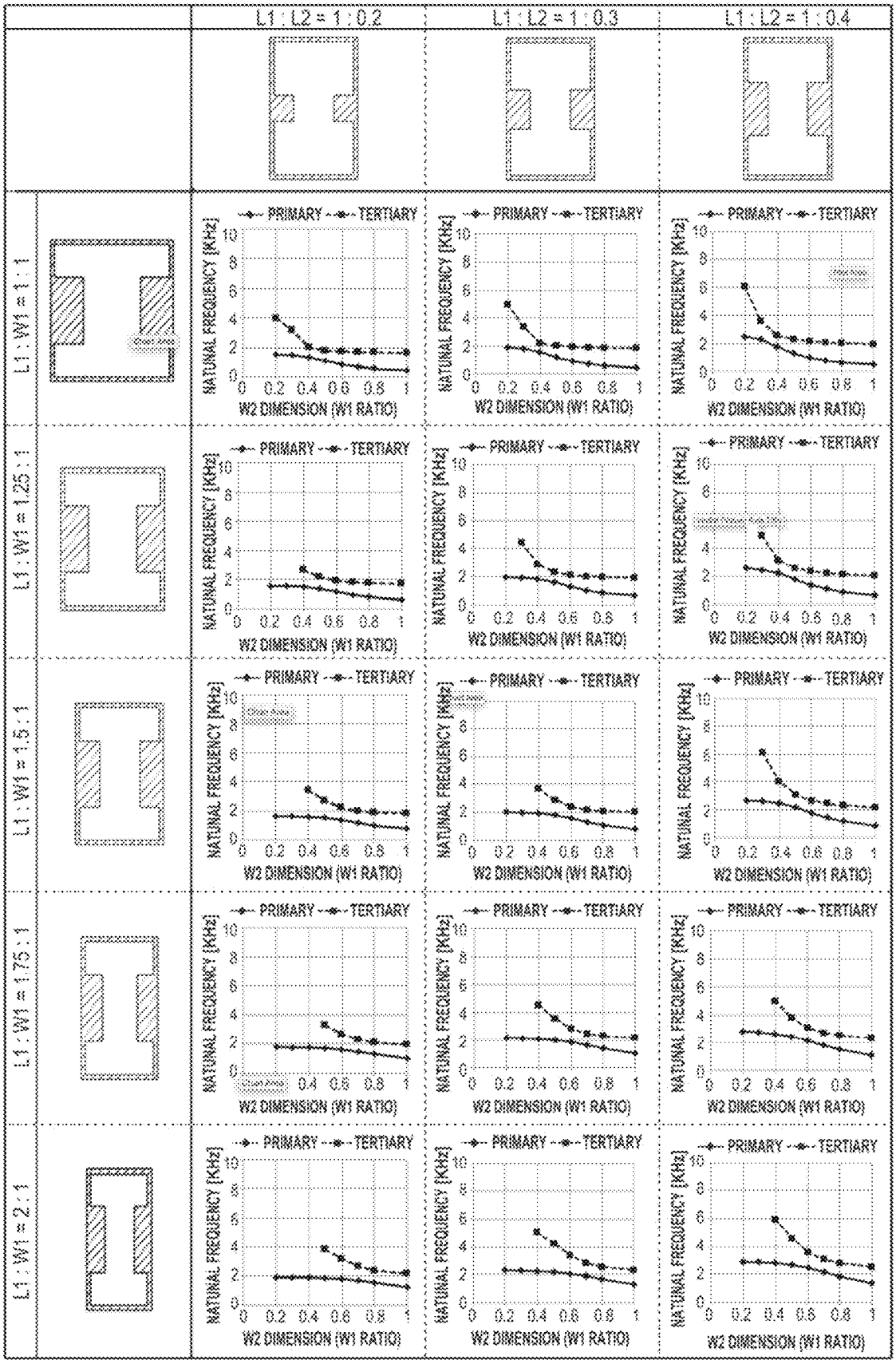
FIG. 19 illustrates changes in a primary natural frequency ♦ and changes in a tertiary natural frequency ■ when L1:L2 is 1:0.2, 1:0.3, and 1:04, L1:W1 is 1:1, 1.25:1, 1.5:1, 1.75:1, and 2:1, and W2/W1 is changed in the range from 0.2 to 1 in the third embodiment.
Figure 20:
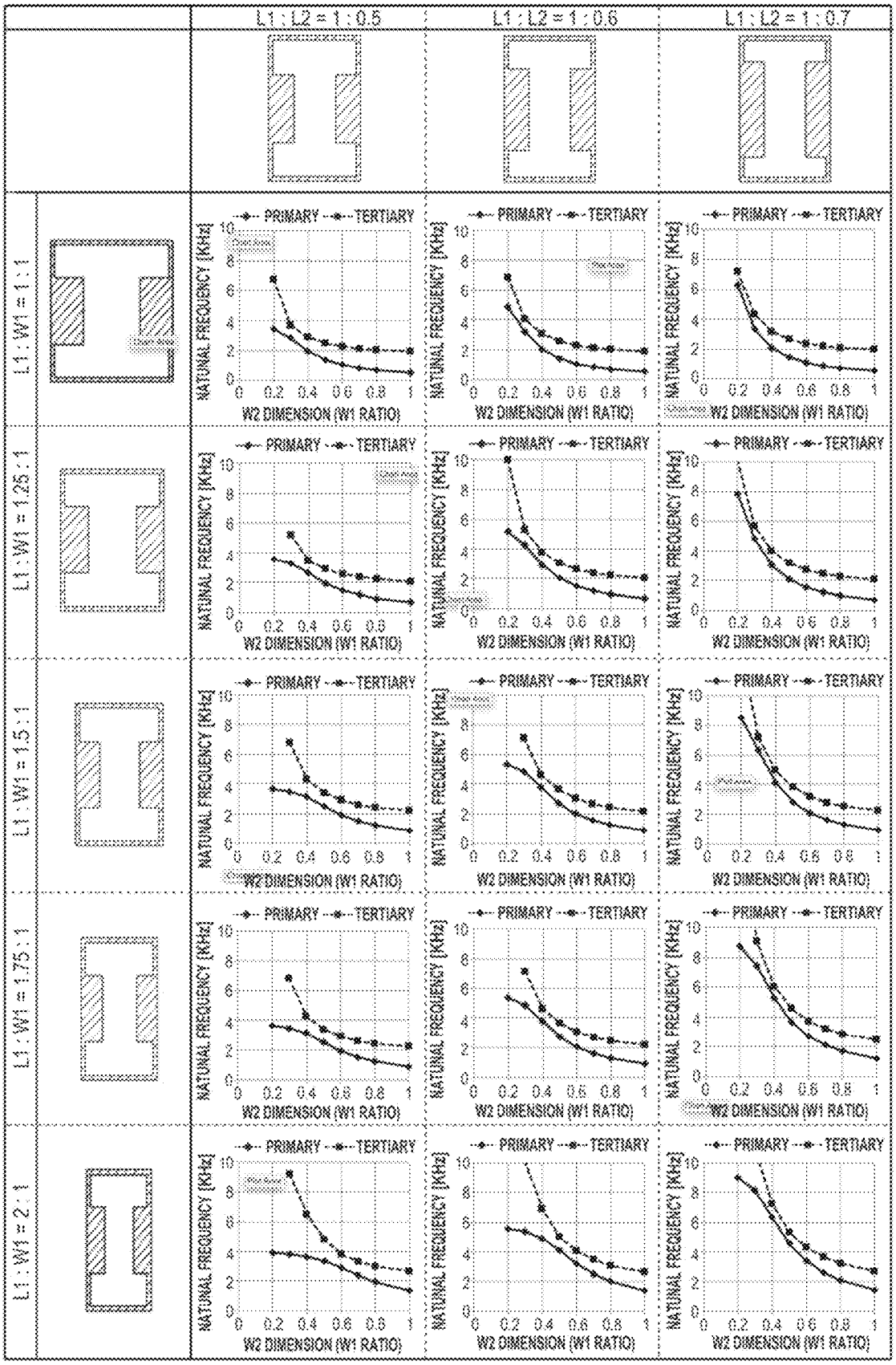
FIG. 20 illustrates changes in the primary natural frequency ♦ and changes in the tertiary natural frequency ■ when L1:L2 is 1:0.5, 1:0.6, and 1:0.7, L1:W1 is 1:1, 1.25:1, 1.5:1, 1.75:1, and 2:1, and W2/W1 is changed in the range from 0.2 to 1 in the third embodiment.
Figure 21A:
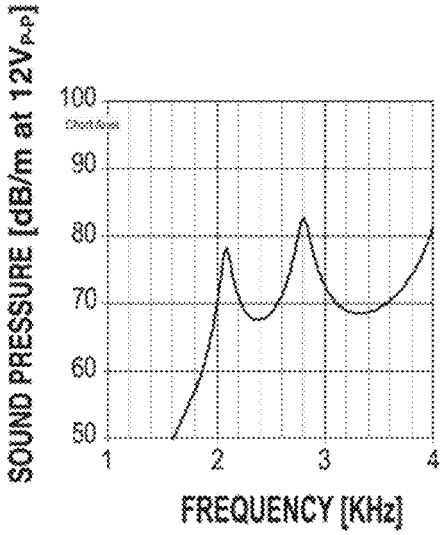
FIGS. 21(A) to (I) illustrate the frequency characteristics with respect to the sound pressure obtained when using only the piezoelectric sounding element while changing L1:L2 and L1:W1 in the third embodiment.
Figure 21B:
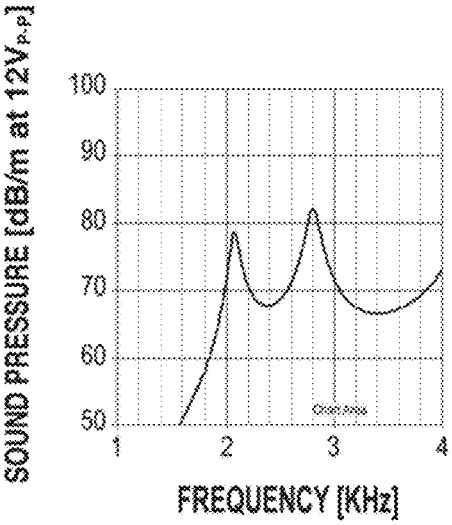
Figure 21C:
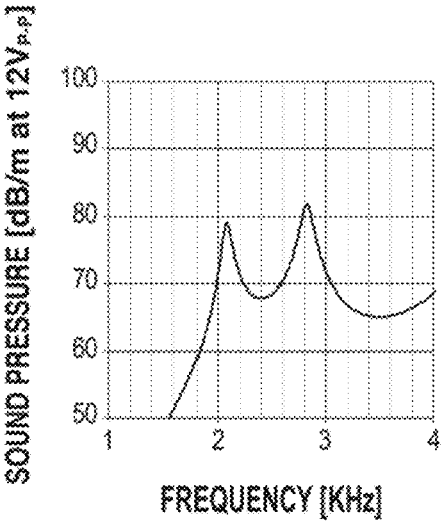
Figure 21D:
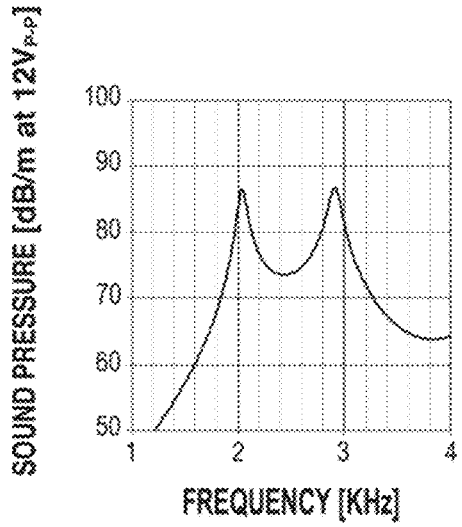
Figure 21E:
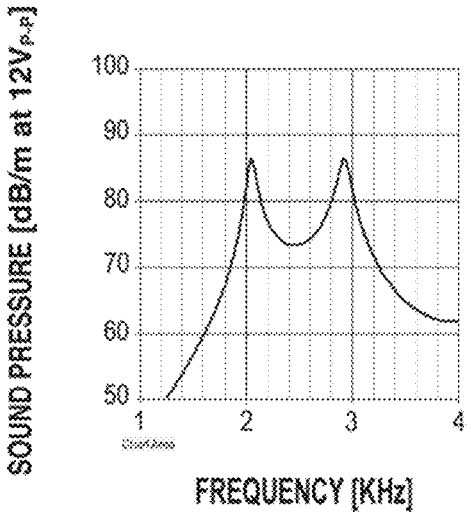
Figure 21F:
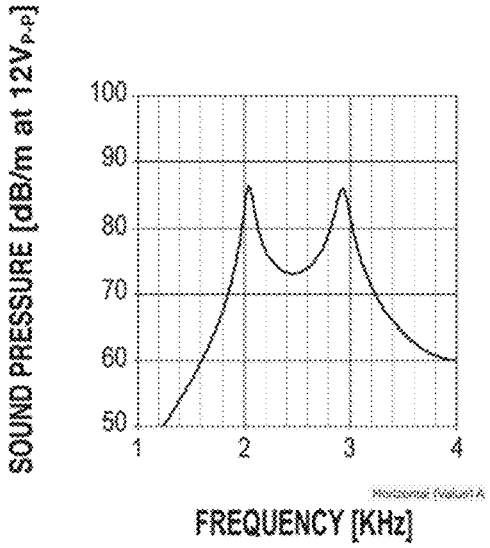
Figure 21G:
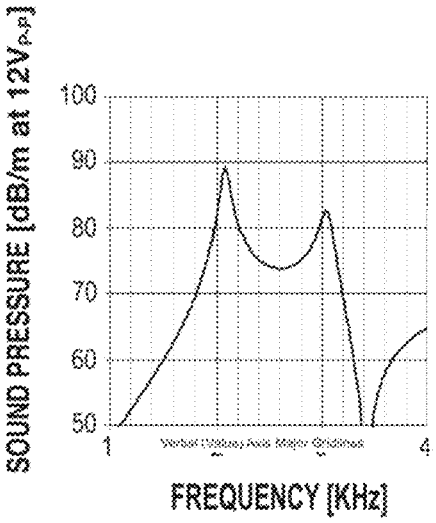
Figure 21H:
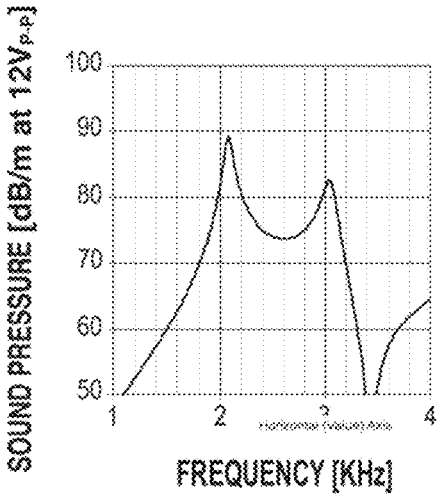
Figure 21I:
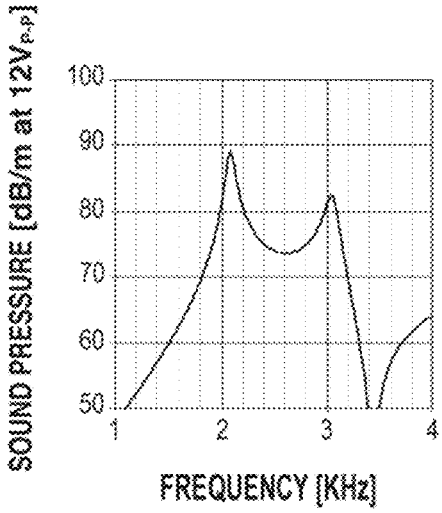
Figure 22A:
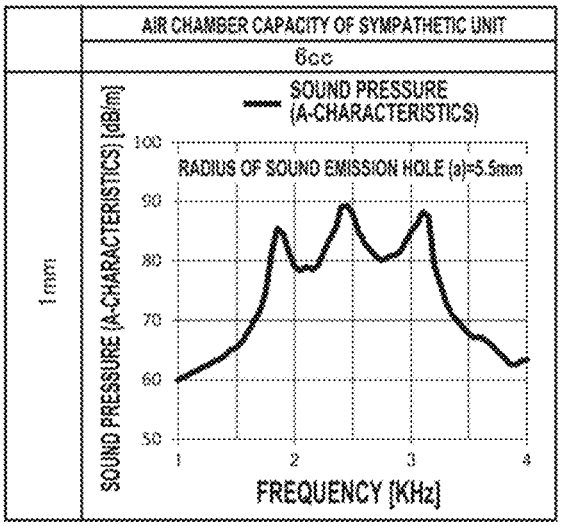
FIGS. 22(A) to (E) illustrate the test results of changes in the frequency characteristics with respect to the sound pressure when the diameter of sound emission holes and the air chamber capacity are changed with the thickness of the sound emission holes kept constant in a fourth embodiment.
Figure 22B:
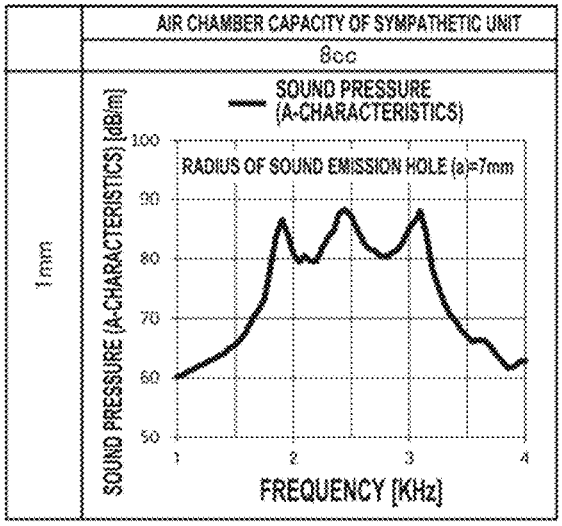
Figure 22C:
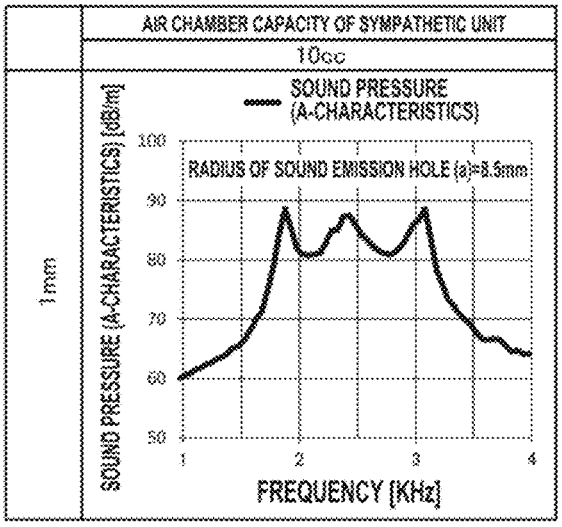
Figure 22D:
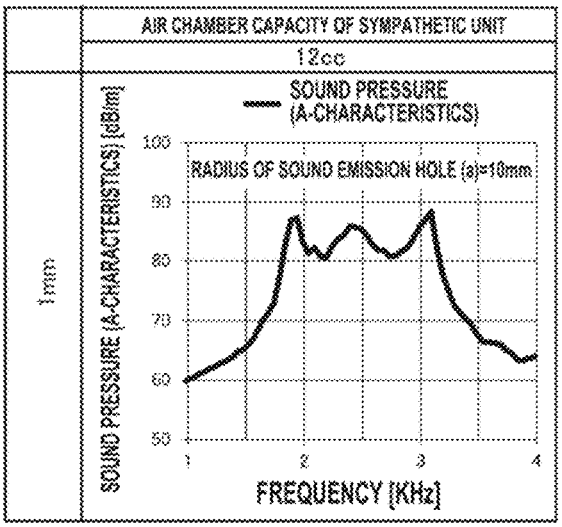
Figure 22E:
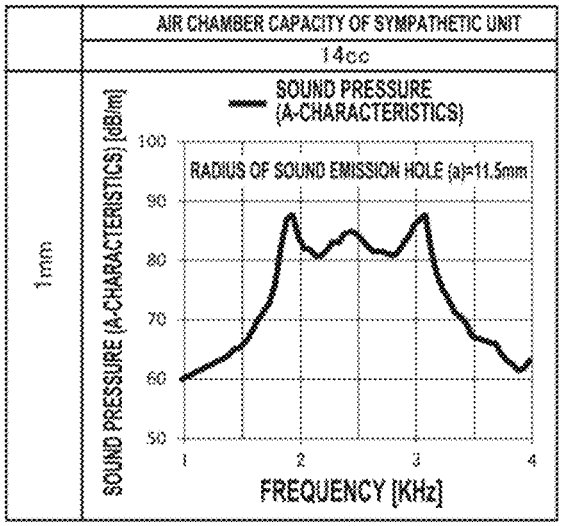

FIG. 19 illustrates changes in the primary natural frequency ♦ and changes in a tertiary natural frequency ■ in the case where a sinusoidal signal is input as an input signal when L1:L2 is 1:0.2, 1:0.3, and 1:0.4, L1:W1 is 1.25:1, 1.5:1, 1.75:1, and 2:1, and W2/W1 is changed in the range from 0.2 to 1 in FIG. 18(A) in the embodiment. In addition, FIG. 20 illustrates changes in the primary natural frequency ♦ and changes in the tertiary natural frequency ■ when L1:L2 is 1:0.5, 1:0.6, and 1:0.7, L1:W1 is 1.25:1, 1.5:1, 1.75:1, and 2:1, and W2/W1 is changed in the range from 0.2 to 1 in (A) of FIG. 18 in the embodiment.

In addition, FIGS. 21 (A) to (C) illustrate the frequency characteristics with respect to the sound pressure obtained in the case where a sinusoidal signal is input as an input signal when L1:L2 is 1:0.4 and L1:W1 is 1.4:1, 1.5:1, and 1.6:1 and only the piezoelectric sounding element is used. In addition, FIGS. 21 (D) to (F) illustrate the frequency characteristics with respect to the sound pressure obtained in the case where a sinusoidal signal is input as an input signal when L1:L2 is 1:0.5 and L1:W1 is 1:1, 1.4:1, 1.5:1, and 1.6:1 and only the piezoelectric sounding element is used. In addition, FIGS. 21(G) to (I) illustrate the frequency characteristics with respect to the sound pressure obtained in the case where a sinusoidal signal is input as an input signal when L1:L2 is 1:0.6 and L1:W1 is 1:1, 1.4:1, 1.5:1, and 1.6:1 and only the piezoelectric sounding element is used. As is clear from FIG. 19 to FIG. 21, when ratio L1/W1 of length L1 of the long sides to length W1 of short sides is defined so as to fall within the range from 1.25 to 1.75, ratio L2/L1 of length L2 of the openings opened in the long sides of the recesses of the non-fixed portion of the diaphragm to length L1 of the long sides is 0.4 to 0.7, and ratio W2/W1 of dimension W2 between the pair of recesses in the direction toward the second imaginary line to length W1 of the short sides is 0.4 to 0.95, the sound pressure is increased in the range from approximately 2 kHz to 3 kHz. When these piezoelectric sounding elements are housed in a case that configures one or more resonators, the total opening area of one or more sound emission holes and the air chamber capacity are defined so that the sound pressures of the primary resonance frequency, the tertiary resonance frequency, and the intermediate frequency between the primary resonance frequency and the tertiary resonance frequency when a sinusoidal signal is input as an input signal are 80 dB or more. In addition, the total opening area of one or more sound emission holes and the air chamber capacity are preferably defined so that the sound pressure at the intermediate frequency between the primary resonance frequency and the tertiary resonance frequency when a sinusoidal signal is input as an input signal is equal to or higher than the sound pressure at the primary resonance frequency and the sound pressure at the tertiary resonance frequency.

Fourth Embodiment

In a fourth embodiment, the diaphragm of the piezoelectric sounding element is rectangular and the piezoelectric element is pasted to the back surface of the diaphragm as in the third embodiment illustrated in FIGS. 18 (A) and (B) and the contour shape of the non-fixed portion of the diaphragm is a so-called dumbbell shape that does not have the inclined straight line portions of the non-fixed portions of the diaphragms according to the first embodiment and the second embodiment. That is, the recesses (13C) have a complete rectangular shape. Ratio L1/W1 of length L1 (30 mm) of the long sides to length W1 (21 mm) of the short sides of the diaphragm (12) used was 1.43, ratio L2/L1 of length L2 (15 mm) of the openings opened in the long sides of the recesses of the non-fixed portion of the diaphragm to length L1 of the long sides was 0.5, and ratio W2/W1 of dimension W2 (12 mm) between the pair of recesses in the direction toward the second imaginary line to length W1 of the short sides was 0.57. In addition, in the embodiment, one sound emission hole (4) is formed at the center of the top wall portion of the case upper half as in the second embodiment. In addition, the non-fixed portion (13) of the diaphragm (12) is formed by an alloy plate having a thickness of 50 μm in which nickel is mixed with iron. In addition, the piezoelectric element has a structure in which a plurality of PZT ceramic layers each having a thickness of 20 μm is stacked with each other. In addition, an acrylic adhesive for bonding the piezoelectric element to the diaphragm has a Shore D hardness of 82 and a thickness of 1 μm to 10 μm.

FIGS. 22(A) to (E) illustrate the test results of changes in the frequency characteristics with respect to the sound pressure in the case where a sinusoidal signal is input as an input signal when the thickness of the sound emission hole (4) is 1 mm and the radius of the sound emission hole (4) and the air chamber capacity are 5.5 mm and 6 cc, 7 mm and 8 cc, 8.5 mm and 10 cc, 10 mm and 10 cc, and 11.5 mm and 14 cc, respectively. As is clear from FIGS. 22 (A) to (E), the sound pressures of the primary resonance frequency, the tertiary resonance frequency, and the intermediate frequency between the primary resonance frequency and the tertiary resonance frequency when a sinusoidal signal is input as an input signal are 80 dB or more in any conditions. In addition, in examples of FIGS. 22 (A) and (B), the sound pressure at the intermediate frequency between the primary resonance frequency and the tertiary resonance frequency is equal to or higher than the sound pressure at the primary resonance frequency and the sound pressure at the tertiary resonance frequency. In examples FIGS. 22 (C) to (E), the resonator is configured so that the minimum sound pressure between the primary resonance frequency and the intermediate frequency and the minimum sound pressure between the intermediate frequency and the tertiary resonance frequency are also 80 dB or more in the frequency range from 1.8 kHz to 3.2 kHz. Accordingly, the sound pressure is increased and the difference between sound pressures is small in a considerably wide frequency range, so sound becomes flat advantageously also in the case where sound is swept.

Tests were performed in the same conditions when the thickness of the sound emission hole is 2 mm and 3 mm and it was found that the thickness of the sound emission hole did not have effects on changes in the sound pressure. In addition, the same frequency characteristics with respect to the sound pressure as in the examples of FIGS. 22 (C) to (E) are obtained as long as L1/W1 ranges from 1.40 to 1.45, L2/L1 ranges from 0.45 to 0.55, and W2/W1 ranges from 0.55 to 0.59.

INDUSTRIAL APPLICABILITY

According to the invention, it is possible to provide a piezoelectric acoustic component capable of emitting audible sound of multiple musical scales even in a noisy place.

REFERENCE SIGNS LIST

1: piezoelectric acoustic component
3: case lower half
4: sound emission hole
5: case upper half
6: case
7: opening
7A: long side
7B: short side
7C: protrusion
9: sounding element holder
11: piezoelectric sounding element
12: diaphragm
13: non-fixed portion
13A: long side
13B: short side
13C: recess
13Ca: parallel straight line portion
13Cb: inclined straight line portion
15: piezoelectric element
15A: straight line portion

15B: curved portion
31: bottom wall portion
32: peripheral wall portion
51: top wall portion
52: peripheral wall portion
PL1: first imaginary line
PL2: second imaginary line
S1: first space
S2: second space

The invention claimed is:

1. A piezoelectric acoustic component comprising:

a piezoelectric sounding element including a diaphragm made of metal and a piezoelectric element provided on at least one surface of the diaphragm; and a case that fixes an outer peripheral portion of the diaphragm of the piezoelectric sounding element across an entire circumference, forms a first space and a second space on both sides of the piezoelectric sounding element, and configures a resonator by a volume of the first space and one or more sound emission holes formed in a wall portion facing the first space, wherein a non-fixed portion located inside the outer peripheral portion of the diaphragm includes a pair of long sides that face each other, a pair of short sides, shorter than the long sides, that face each other, and a pair of recesses, provided in the pair of long sides, that protrude in a direction approaching each other, the piezoelectric element is provided in a region between the pair of recesses of the non-fixed portion of the diaphragm, both a contour shape of the diaphragm and a contour shape of the piezoelectric element are defined so as to be symmetric with respect to a first imaginary line that bisects the pair of short sides and symmetric with respect to a second imaginary line that bisects the pair of long sides, ratio L1/W1 of length L1 of the long sides to length W1 of the short sides of the non-fixed portion of the diaphragm is defined so as to fall within a range from 1.25 to 1.75, and the resonator is configured such that sound pressures at a primary resonance frequency, a tertiary resonance frequency, and an intermediate frequency between the primary resonance frequency and the tertiary resonance frequency when a sine wave signal is input as an input signal are 80 dB or more.

2. The piezoelectric acoustic component according to claim 1, wherein the resonator is configured such that the sound pressure at the intermediate frequency is equal to or higher than the sound pressure at the primary resonance frequency and the sound pressure at the tertiary resonance frequency.

3. The piezoelectric acoustic component according to claim 1, wherein the resonator is configured such that a minimum sound pressure between the primary resonance frequency and the intermediate frequency and a minimum sound pressure between the intermediate frequency and the tertiary resonance frequency are 80 dB or more.

4. The piezoelectric acoustic component according to claim 1, wherein the case includes a sounding element holder having an opening with the same shape as a contour shape of the non-fixed portion of the diaphragm and fixes the outer peripheral portion of the diaphragm.

5. The piezoelectric acoustic component according to claim 1, wherein each of the pair of short sides has, in both end portions, a pair of inclined portions inclined so as to approach each other.

6. The piezoelectric acoustic component according to claim 1, wherein the piezoelectric element is provided on a back surface of the diaphragm.

7. The piezoelectric acoustic component according to claim 1, wherein each of the recesses of the non-fixed portion of the diaphragm includes a parallel straight line portion extending in parallel with the first imaginary line and a pair of inclined straight line portions extending away from both end portions of the parallel straight line portion to corresponding remaining portions of one of the long sides and an outline of the piezoelectric element includes a pair of straight line portions along the parallel straight line portions of each of the pair of recesses and a pair of curved portions each of which is curved so as to protrude toward the pair of the short sides in a region sandwiched between the two inclined straight line portions of the pair of recesses facing each other in a direction in which the second imaginary line extends.

8. The piezoelectric acoustic component according to claim 1, wherein each of the recesses of the non-fixed portion of the diaphragm includes a parallel straight line portion extending in parallel with the second imaginary line and a pair of protruding curved portions that extend away from both end portions of the parallel straight line portion and are curved so as to protrude toward the recess, and an outline of the piezoelectric element includes a pair of straight line portions along the parallel straight line portions of the pair of recesses and curved portions each of which is curved so as to protrude toward the pair of the short sides in a region sandwiched between the two protruding curved portions of the pair of recesses facing each other in a direction in which the second imaginary line extends.

9. The piezoelectric acoustic component according to claim 1, wherein each of the recesses of the non-fixed portion of the diaphragm is a curved recess curved so as to protrude toward the first imaginary line and an outline of the piezoelectric element has curved portions curved so as to protrude toward the pair of short sides in a region sandwiched between the pair of curved recesses along the pair of curved recesses.

10. The piezoelectric acoustic component according to claim 2, wherein the non-fixed portion of the diaphragm is formed by an alloy plate having a thickness of 10 μm to 150 μm in which nickel is mixed with iron, the piezoelectric element has a structure in which a plurality of PZT ceramic layers each having a thickness of 10 μm to 35 μm is stacked, and an acrylic adhesive for bonding the piezoelectric element to the diaphragm has a Shore D hardness of 75 to 85 and a thickness of 1 μm to 10 μm.

11. A piezoelectric acoustic component comprising:

a piezoelectric sounding element including a diaphragm made of metal and a piezoelectric element provided on at least one surface of the diaphragm; and a case that fixes an outer peripheral portion of the diaphragm of the piezoelectric sounding element across an entire circumference, forms a first space and a second space on both sides of the piezoelectric sounding element, and configures a resonator in which one or more sound emission holes are formed in a wall portion facing the first space, wherein a non-fixed portion located inside the outer peripheral portion of the diaphragm includes a pair of long sides that face each other, a pair of short sides, shorter than the long sides, that face each other, and a pair of recesses, provided in the pair of long sides, that protrude so as to approach each other, the piezoelectric element is provided in a region between the pair of recesses of the non-fixed portion of the diaphragm, both a contour shape of the diaphragm and a contour shape of the piezoelectric element are defined so as to be symmetric with respect to a first imaginary line that bisects the pair of short sides and symmetric with respect to a second imaginary line that bisects the pair of long sides, ratio L1/W1 of length L1 of the long sides to length W1 of the short sides is defined so as to fall within a range from 1.25 to 1.75, ratio L2/L1 of length L2 of an opening opened in the long sides of the recesses of the non-fixed portion of the diaphragm to length L1 of the long sides is 0.4 to 0.7 and ratio W2/W1 of dimension W2 between the pair of recesses in the direction toward the second imaginary line to the length W1 of the short sides is 0.4 to 0.95, and a total opening area of the one or more sound emission holes and an air chamber capacity of the resonator are defined such that sound pressures at a primary resonance frequency, a tertiary resonance frequency, and an intermediate frequency between the primary resonance frequency and the tertiary resonance frequency when a sine wave signal is input as an input signal are 80 dB or more.

12. The piezoelectric acoustic component according to claim 11, wherein the piezoelectric element is provided on a back surface of the diaphragm.

13. The piezoelectric acoustic component according to claim 12, wherein the resonator is configured such that a minimum sound pressure between the primary resonance frequency and the intermediate frequency and a minimum sound pressure between the intermediate frequency and the tertiary resonance frequency are 80 dB or more.

14. The piezoelectric acoustic component according to claim 13, wherein the ratio L1/W1 is 1.40 to 1.45, the ratio L2/L1 is 0.45 to 0.55, and the ratio W2/W1 is 0.55 to 0.59.

15. The piezoelectric acoustic component according to claim 2, wherein each of the pair of short sides has, in both end portions, a pair of inclined portions inclined so as to approach each other.

16. The piezoelectric acoustic component according to claim 3, wherein each of the pair of short sides has, in both end portions, a pair of inclined portions inclined so as to approach each other.

17. The piezoelectric acoustic component according to claim 4, wherein each of the pair of short sides has, in both end portions, a pair of inclined portions inclined so as to approach each other.

18. The piezoelectric acoustic component according to claim 2, wherein the piezoelectric element is provided on a back surface of the diaphragm.

19. The piezoelectric acoustic component according to claim 3, wherein the piezoelectric element is provided on a back surface of the diaphragm.

20. The piezoelectric acoustic component according to claim 4, wherein the piezoelectric element is provided on a back surface of the diaphragm.

* * * * *